US012560072B2

(12) United States Patent
Li et al.

(10) Patent No.: US 12,560,072 B2
(45) Date of Patent: Feb. 24, 2026

(54) GEOSTEERING CONTROL FRAMEWORK

(71) Applicant: Schlumberger Technology Corporation, Sugar Land, TX (US)

(72) Inventors: Zhenhua Li, Singapore (SG); Joseph Gremillion, Sugar Land, TX (US); Farid Toghi, Clamart (FR); Fei Wang, Tianjin (CN); Chao Wang, Shenzhen (CN)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/583,989

(22) Filed: Feb. 22, 2024

(65) Prior Publication Data

US 2025/0270915 A1 Aug. 28, 2025

(51) Int. Cl.

| | |
|---|---|
| ***E21B 7/04*** | (2006.01) |
| ***E21B 44/00*** | (2006.01) |
| ***E21B 49/00*** | (2006.01) |

(52) U.S. Cl.

CPC ..... *E21B 44/00* (2013.01); *E21B 7/04* (2013.01); *E21B 49/00* (2013.01); *E21B 2200/20* (2020.05); *E21B 2200/22* (2020.05)

(58) Field of Classification Search

CPC . E21B 44/00; E21B 7/04; E21B 49/00; E21B 2200/20; E21B 2200/22

See application file for complete search history.

(56) References Cited

U.S. PATENT DOCUMENTS

| | | | | |
|---|---|---|---|---|
| 11,531,138 | B2 | 12/2022 | Liang | |
| 11,880,776 | B2 * | 1/2024 | Shan | G06N 3/08 |
| 2019/0169986 | A1 | 6/2019 | Storm, Jr. | |
| 2019/0259493 | A1 * | 8/2019 | Xu | G16H 30/40 |
| 2020/0011158 | A1 * | 1/2020 | Xu | E21B 44/005 |
| 2022/0170359 | A1 * | 6/2022 | Boualleg | E21B 44/00 |
| 2022/0342111 | A1 * | 10/2022 | Liang | E21B 49/00 |
| 2023/0193751 | A1 * | 6/2023 | Li | E21B 49/00 703/11 |
| 2023/0400598 | A1 * | 12/2023 | Edwards | G06N 20/00 |

FOREIGN PATENT DOCUMENTS

NO 20210007 A1 1/2021

OTHER PUBLICATIONS

Search Report and Written Opinion of International Application No. PCT/US2024/016981 dated Nov. 8, 2024, 13 pages.

Chen et al., "XGBoost: A Scalable Tree Boosting System", arXiv:1603.02754, 2016.

* cited by examiner

*Primary Examiner* — Taras P Bemko

(74) *Attorney, Agent, or Firm* — Jeffrey D. Frantz

(57) ABSTRACT

A method may include receiving data acquired by a downhole tool of a tool string disposed at least in part in a borehole in a subsurface region; predicting a position of a formation top in the subsurface region using a trained machine learning model and at least a portion of the data; and controlling operation of the tool string based at least in part on the position of the formation top in the subsurface region.

17 Claims, 13 Drawing Sheets

A. Correlation versus vertical offset wells for tying into geology of build section B. Correlation versus vertical offset wells for predicting landing point of landing section C. Steering lateral section A. Correlation versus vertical offset wells for tying into geology of build section B. Correlation versus vertical offset wells for predicting landing point of landing section C. Steering lateral section

GEOSTEERING CONTROL FRAMEWORK

BACKGROUND

Geosteering may provide for directional control of a drill bit of a drillstring using downhole geological logging measurements, for example, to keep a directional wellbore within a pay zone. In various scenarios, geosteering may be used to keep a wellbore in a particular section of a reservoir to minimize gas or water breakthrough and maximize hydrocarbon production.

SUMMARY

A method may include receiving data acquired by a downhole tool of a tool string disposed at least in part in a borehole in a subsurface region; predicting a position of a formation top in the subsurface region using a trained machine learning model and at least a portion of the data; and controlling operation of the tool string based at least in part on the position of the formation top in the subsurface region. A system may include a processor; memory accessible to the processor; and processor-executable instructions stored in the memory and executable by the processor to instruct the system to: receive data acquired by a downhole tool of a tool string disposed at least in part in a borehole in a subsurface region; predict a position of a formation top in the subsurface region using a trained machine learning model and at least a portion of the data; and control operation of the tool string based at least in part on the position of the formation top in the subsurface region. One or more non-transitory computer-readable storage media may include processor-executable instructions executable to instruct a processor to: receive data acquired by a downhole tool of a tool string disposed at least in part in a borehole in a subsurface region; predict a position of a formation top in the subsurface region using a trained machine learning model and at least a portion of the data; and control operation of the tool string based at least in part on the position of the formation top in the subsurface region. Various other apparatuses, systems, methods, etc., are also disclosed.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations may be more readily understood by reference to the following description taken in conjunction with the accompanying drawings.

DETAILED DESCRIPTION

The following description includes embodiments of the best mode presently contemplated for practicing the described implementations. This description is not to be taken in a limiting sense, but rather is made merely for the purpose of describing the general principles of the implementations. The scope of the described implementations should be ascertained with reference to the issued claims.

As mentioned, geosteering may provide for directional control of a drill bit of a drillstring using downhole geological logging measurements, for example, to keep a directional wellbore within a pay zone where, in various scenarios, geosteering may be used to keep a wellbore in a particular section of a reservoir to minimize gas or water breakthrough and maximize hydrocarbon production.

A borehole may be referred to as a wellbore and may include an openhole portion or an uncased portion and/or may include a cased portion. A borehole may be defined by a bore wall that is composed of rock that bounds the borehole. As to a well or a borehole, whether for one or more of exploration, sensing, production, injection or other operation(s), it may be planned. Such a process may be referred to generally as well planning, a process by which a path may be mapped in a geologic environment. Such a path may be referred to as a trajectory, which may include coordinates in a three-dimensional coordinate system where a measure along the trajectory may be a measured depth (MD), a total vertical depth (TVD) or another type of measure.

As an example, drilling may include using one or more logging tools that may perform one or more logging operations while drilling or otherwise with a drillstring (e.g., while stationary, while tripping in, tripping out, etc.). As an example, drilling or one or more other operations may occur responsive to measurements. For example, a logging while drilling operation may acquire measurements and adjust drilling based at least in part on such measurements. In such an example, adjustments may be made by actuating one or more geosteering actuators that may provide for orienting a drill bit of a drillstring.

Figure 1:
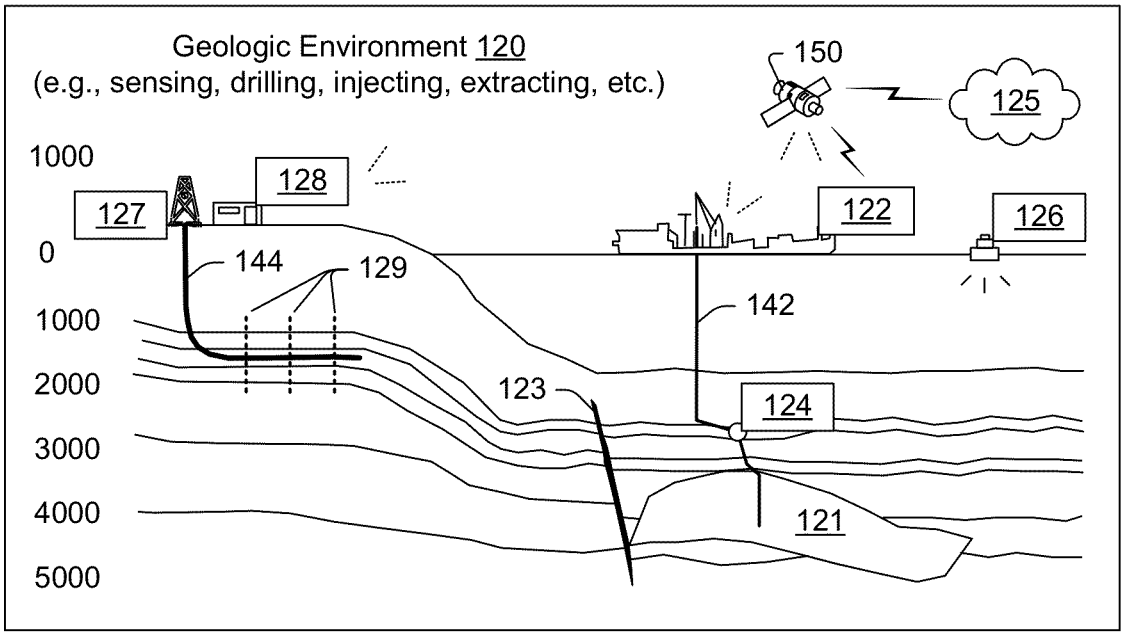
FIG. 1 illustrates examples of equipment in a geologic environment.
Figure 1:
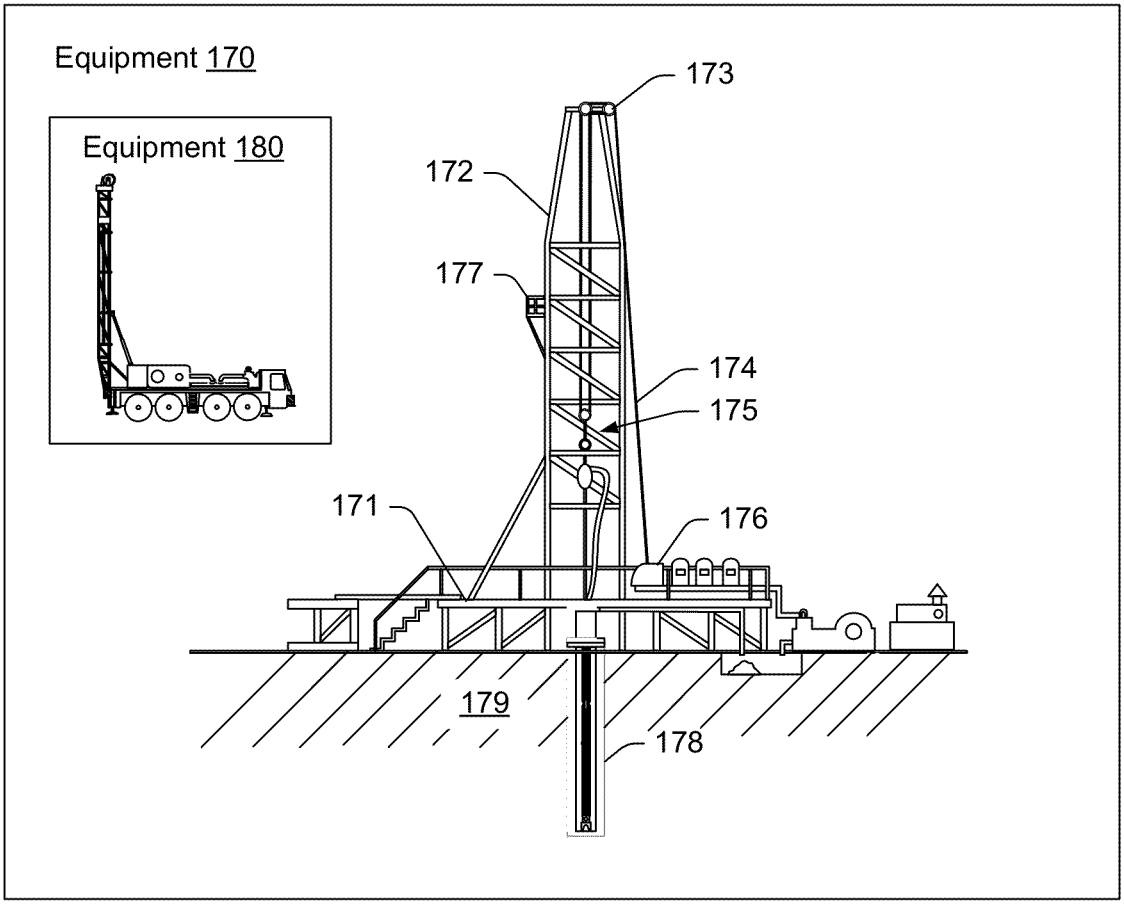

FIG. 1 shows an example of a geologic environment 120. In FIG. 1, the geologic environment 120 may be a sedimentary basin that includes layers (e.g., stratification) that include a reservoir 121 and that may be, for example, intersected by a fault 123 (e.g., or faults). As an example, the geologic environment 120 may be outfitted with a variety of sensors, detectors, actuators, etc. For example, equipment 122 may include communication circuitry to receive and/or to transmit information with respect to one or more networks 125. Such information may include information associated with downhole equipment 124, which may be equipment to acquire information, to assist with resource recovery, etc. For example, the downhole equipment 124 may be disposed in a bore 142 that is formed by a borewall of one or more types of rock. Other equipment 126 may be located remote from a well site and include sensing, detecting, emitting or other circuitry. Such equipment may include storage and communication circuitry to store and to communicate data, instructions, etc. As an example, one or more pieces of equipment may provide for measurement, collection, communication, storage, analysis, etc. of data (e.g., for one or more produced resources, etc.). As an example, one or more satellites may be provided for purposes of communications, data acquisition, geolocation, etc. For example, FIG. 1 shows a satellite 150 in communication with the network 125 that may be configured for communications, noting that the satellite 150 may additionally or alternatively include circuitry for imagery (e.g., spatial, spectral, temporal, radiometric, etc.).

FIG. 1 also shows the geologic environment 120 as optionally including equipment 127 and 128 associated with a well 144 that includes a substantially horizontal portion that may intersect with one or more fractures 129. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop the reservoir (e.g., via fracturing, injecting, extracting, etc.). As an example, the equipment 127 and/or 128 may include components, a system, systems, etc. for fracturing, seismic sensing, analysis of seismic data, NMR logging, assessment of one or more fractures, injection, production, etc. As an example, the equipment 127 and/or 128 may provide for measurement, collection, communication, storage, analysis, etc. of data such as, for example, formation data, fluid data, production data (e.g., for one or more produced resources), etc. As an example, one or more satellites such as the satellite 150 may be provided for purposes of communications, data acquisition, etc.

FIG. 1 also shows an example of equipment 170 and an example of equipment 180. Such equipment, which may be systems of components, may be suitable for use in the geologic environment 120. While the equipment 170 and 180 are illustrated as land-based, various components may be suitable for use in an offshore system. As shown in FIG. 1, the equipment 180 may be mobile as carried by a vehicle; noting that the equipment 170 may be assembled, disassembled, transported and re-assembled, etc.

The equipment 170 includes a platform 171, a derrick 172, a crown block 173, a line 174, a traveling block assembly 175, drawworks 176 and a landing 177 (e.g., a monkeyboard). As an example, the line 174 may be controlled at least in part via the drawworks 176 such that the traveling block assembly 175 travels in a vertical direction with respect to the platform 171. For example, by drawing the line 174 in, the drawworks 176 may cause the line 174 to run through the crown block 173 and lift the traveling block assembly 175 skyward away from the platform 171; whereas, by allowing the line 174 out, the drawworks 176 may cause the line 174 to run through the crown block 173 and lower the traveling block assembly 175 toward the platform 171. Where the traveling block assembly 175 carries pipe (e.g., casing, etc.), tracking of movement of the traveling block assembly 175 may provide an indication as to how much pipe has been deployed. As shown, movement of the traveling block assembly 175 may provide for movement of equipment into and out of a bore 178 in a formation 179.

A derrick may be a structure used to support a crown block and a traveling block operatively coupled to the crown block at least in part via line. A derrick may be pyramidal in shape and offer a suitable strength-to-weight ratio. A derrick may be movable as a unit or in a piece-by-piece manner (e.g., to be assembled and disassembled).

As an example, drawworks may include a spool, brakes, a power source and assorted auxiliary devices. Drawworks may controllably reel out and reel in line. Line may be reeled over a crown block and coupled to a traveling block to gain mechanical advantage in a "block and tackle" or "pulley" fashion. Reeling out and in of line may cause a traveling block (e.g., and whatever may be hanging underneath it), to be lowered into or raised out of a bore. Reeling out of line may be powered by gravity and reeling in by a motor, an engine, etc. (e.g., an electric motor, a diesel engine, etc.).

As an example, a crown block may include a set of pulleys (e.g., sheaves) that may be located at or near a top of a derrick or a mast, over which line is threaded. A traveling block may include a set of sheaves that may be moved up and down in a derrick or a mast via line threaded in the set of sheaves of the traveling block and in the set of sheaves of a crown block. A crown block, a traveling block and a line may form a pulley system of a derrick or a mast, which may enable handling of heavy loads (e.g., drillstring, pipe, casing, liners, etc.) to be lifted out of or lowered into a bore. As an example, line may be about a centimeter to about five centimeters in diameter as, for example, steel cable. Through use of a set of sheaves, such line may carry loads heavier than the line could support as a single strand.

As an example, a derrick person may be a rig crew member that works on a platform attached to a derrick or a mast. A derrick may include a landing on which a derrick person may stand. As an example, such a landing may be about 10 meters or more above a rig floor. In an operation referred to as trip out of the hole (TOH or pull out of hole (POOH)), a derrick person may wear a safety harness that enables leaning out from the work landing (e.g., monkeyboard) to reach pipe in located at or near the center of a derrick or a mast and to throw a line around the pipe and pull it back into its storage location (e.g., fingerboards), for example, until it a time at which it may be desirable to run the pipe back into the bore. As an example, a rig may include automated pipe-handling equipment such that the derrick person controls the machinery rather than physically handling the pipe.

As an example, a trip may refer to the act of pulling equipment from a bore (e.g., pull out of hole (POOH)) and/or placing equipment in a bore (e.g., run in hole (RIH)). As an example, equipment may include a drillstring that may be pulled out of the hole and/or place or replaced in the hole. As an example, a pipe trip may be performed where a drill bit has dulled or has otherwise ceased to drill efficiently and is to be replaced. As an example, a trip may be performed when changing section diameter, for example, upon finishing a larger bore diameter section changing equipment to drill a smaller bore diameter section.

Figure 2:
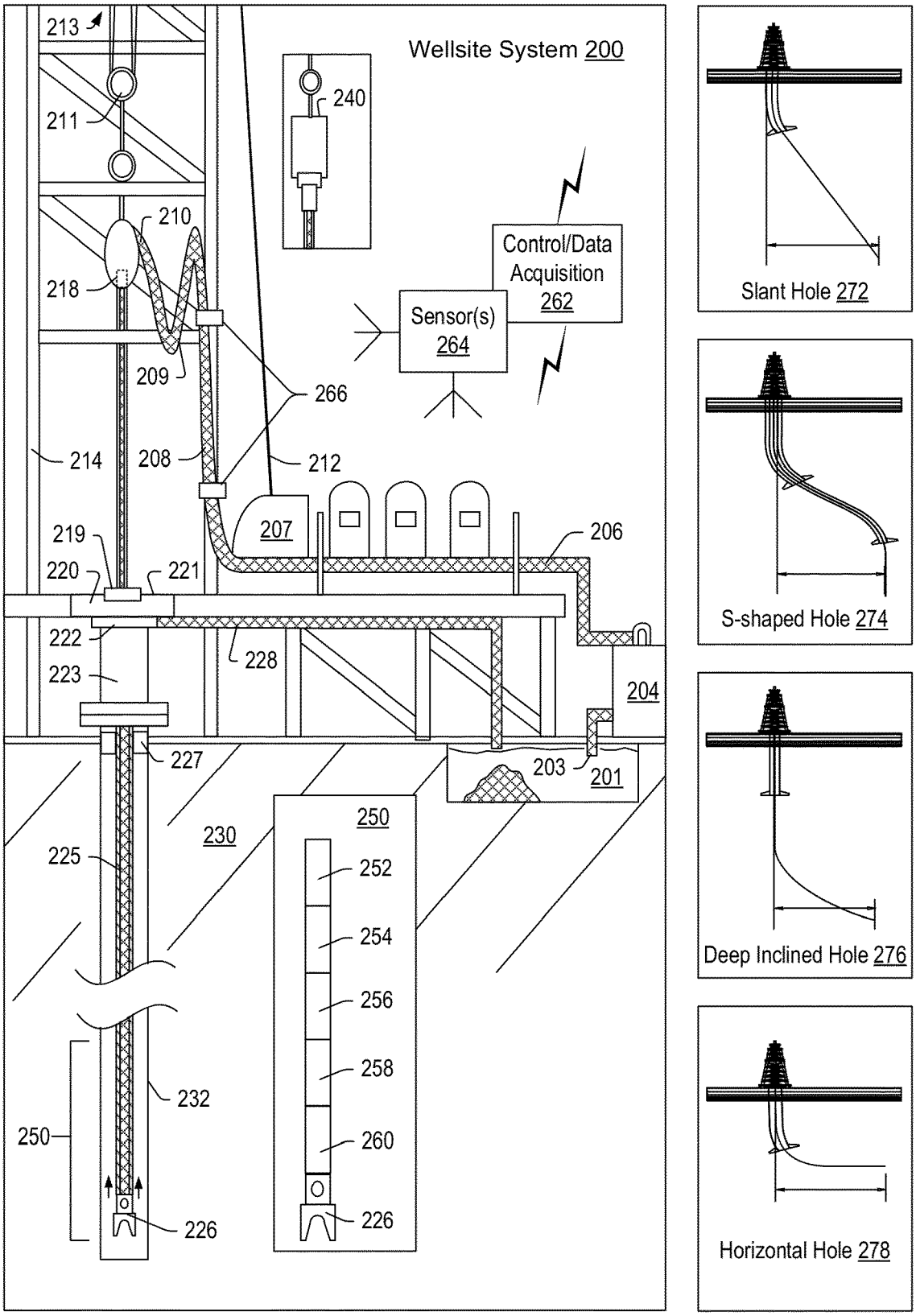
FIG. 2 illustrates an example of a system and examples of types of holes.

FIG. 2 shows an example of a wellsite system 200 (e.g., at a wellsite that may be onshore or offshore). As shown, the wellsite system 200 may include a mud tank 201 for holding mud and other material (e.g., where mud may be a drilling fluid that may help to transport cuttings, etc.), a suction line 203 that serves as an inlet to a mud pump 204 for pumping mud from the mud tank 201 such that mud flows to a vibrating hose 206, a drawworks 207 for winching drill line or drill lines 212, a standpipe 208 that receives mud from the vibrating hose 206, a kelly hose 209 that receives mud from the standpipe 208, a gooseneck or goosenecks 210, a traveling block 211, a crown block 213 for carrying the traveling block 211 via the drill line or drill lines 212 (see, e.g., the crown block 173 of FIG. 1), a derrick 214 (see, e.g., the derrick 172 of FIG. 1), a kelly 218 or a top drive 240, a kelly drive bushing 219, a rotary table 220, a drill floor 221, a bell nipple 222, one or more blowout preventors (BOPs) 223, a drillstring 225, a drill bit 226, a casing head 227 and a flow pipe 228 that carries mud and other material to, for example, the mud tank 201.

In the example system of FIG. 2, a borehole 232 is formed in subsurface formations 230 by rotary drilling; noting that various example embodiments may also use directional drilling or one or more other types of drilling.

As shown in the example of FIG. 2, the drillstring 225 is suspended within the borehole 232 and has a drillstring assembly 250 that includes the drill bit 226 at its lower end. As an example, the drillstring assembly 250 may be a bottom hole assembly (BHA).

The wellsite system 200 may provide for operation of the drillstring 225 and other operations. As shown, the wellsite system 200 includes the platform and the derrick 214 positioned over the borehole 232. As mentioned, the wellsite system 200 may include the rotary table 220 where the drillstring 225 passes through an opening in the rotary table 220.

As shown in the example of FIG. 2, the wellsite system 200 may include the kelly 218 and associated components, etc., or a top drive 240 and associated components. As to a kelly example, the kelly 218 may be a square or hexagonal metal/alloy bar with a hole drilled therein that serves as a mud flow path. The kelly 218 may be used to transmit rotary motion from the rotary table 220 via the kelly drive bushing 219 to the drillstring 225, while allowing the drillstring 225 to be lowered or raised during rotation. The kelly 218 may pass through the kelly drive bushing 219, which may be driven by the rotary table 220. As an example, the rotary table 220 may include a master bushing that operatively couples to the kelly drive bushing 219 such that rotation of the rotary table 220 may turn the kelly drive bushing 219 and hence the kelly 218. The kelly drive bushing 219 may include an inside profile matching an outside profile (e.g., square, hexagonal, etc.) of the kelly 218; however, with slightly larger dimensions so that the kelly 218 may freely move up and down inside the kelly drive bushing 219.

As to a top drive example, the top drive 240 may provide functions performed by a kelly and a rotary table. The top drive 240 may turn the drillstring 225. As an example, the top drive 240 may include one or more motors (e.g., electric and/or hydraulic) connected with appropriate gearing to a short section of pipe called a quill, that in turn may be screwed into a saver sub or the drillstring 225 itself. The top drive 240 may be suspended from the traveling block 211, so the rotary mechanism is free to travel up and down the derrick 214. As an example, a top drive 240 may allow for drilling to be performed with more joint stands than a kelly/rotary table approach.

In the example of FIG. 2, the mud tank 201 may hold mud, which may be one or more types of drilling fluids. As an example, a wellbore may be drilled to produce fluid, inject fluid or both (e.g., hydrocarbons, minerals, water, etc.).

In the example of FIG. 2, the drillstring 225 (e.g., including one or more downhole tools) may be composed of a series of pipes threadably connected together to form a long tube with the drill bit 226 at the lower end thereof. As the drillstring 225 is advanced into a wellbore for drilling, at some point in time prior to or coincident with drilling, the mud may be pumped by the pump 204 from the mud tank 201 (e.g., or other source) via the lines 206, 208 and 209 to a port of the kelly 218 or, for example, to a port of the top drive 240. The mud may then flow via a passage (e.g., or passages) in the drillstring 225 and out of ports located on the drill bit 226 (see, e.g., a directional arrow). As the mud exits the drillstring 225 via ports in the drill bit 226, it may then circulate upwardly through an annular region between an outer surface(s) of the drillstring 225 and surrounding wall(s) (e.g., open borehole, casing, etc.), as indicated by directional arrows. In such a manner, the mud lubricates the drill bit 226 and carries heat energy (e.g., frictional or other energy) and formation cuttings to the surface where the mud (e.g., and cuttings) may be returned to the mud tank 201, for example, for recirculation (e.g., with processing to remove cuttings, etc.).

The mud pumped by the pump 204 into the drillstring 225 may, after exiting the drillstring 225, form a mudcake that lines the wellbore which, among other functions, may reduce friction between the drillstring 225 and surrounding wall(s) (e.g., borehole, casing, etc.). A reduction in friction may facilitate advancing or retracting the drillstring 225. During a drilling operation, the entire drillstring 225 may be pulled from a wellbore and optionally replaced, for example, with a new or sharpened drill bit, a smaller diameter drillstring, etc. As mentioned, the act of pulling a drillstring out of a hole or replacing it in a hole is referred to as tripping. A trip may be referred to as an upward trip or an outward trip or as a downward trip or an inward trip depending on trip direction.

As an example, consider a downward trip where upon arrival of the drill bit 226 of the drillstring 225 at a bottom of a wellbore, pumping of the mud commences to lubricate the drill bit 226 for purposes of drilling to enlarge the wellbore. As mentioned, the mud may be pumped by the pump 204 into a passage of the drillstring 225 and, upon filling of the passage, the mud may be used as a transmission medium to transmit energy, for example, energy that may encode information as in mud-pulse telemetry.

As an example, mud-pulse telemetry equipment may include a downhole device configured to effect changes in pressure in the mud to create an acoustic wave or waves upon which information may modulated. In such an example, information from downhole equipment (e.g., one or more components of the drillstring 225) may be transmitted uphole to an uphole device, which may relay such information to other equipment for processing, control, etc.

As an example, telemetry equipment may operate via transmission of energy via the drillstring 225 itself. For example, consider a signal generator that imparts coded energy signals to the drillstring 225 and repeaters that may receive such energy and repeat it to further transmit the coded energy signals (e.g., information, etc.).

As an example, the drillstring 225 may be fitted with telemetry equipment 252 that includes a rotatable drive shaft, a turbine impeller mechanically coupled to the drive shaft such that the mud may cause the turbine impeller to rotate, a modulator rotor mechanically coupled to the drive shaft such that rotation of the turbine impeller causes said modulator rotor to rotate, a modulator stator mounted adjacent to or proximate to the modulator rotor such that rotation of the modulator rotor relative to the modulator stator creates pressure pulses in the mud, and a controllable brake for selectively braking rotation of the modulator rotor to modulate pressure pulses. In such example, an alternator may be coupled to the aforementioned drive shaft where the alternator includes at least one stator winding electrically coupled to a control circuit to selectively short the at least one stator winding to electromagnetically brake the alternator and thereby selectively brake rotation of the modulator rotor to modulate the pressure pulses in the mud.

In the example of FIG. 2, an uphole control and/or data acquisition system 262 may include circuitry to sense pressure pulses generated by telemetry equipment 252 and, for example, communicate sensed pressure pulses or information derived therefrom for process, control, etc.

The assembly 250 of the illustrated example includes a logging-while-drilling (LWD) module 254, a measurement-while-drilling (MWD) module 256, an optional module 258, a rotary-steerable system (RSS) and/or motor 260, and the drill bit 226. Such components or modules may be referred to as tools where a drillstring may include a plurality of tools.

As to an RSS, it involves technology utilized for direction drilling. Directional drilling involves drilling into the Earth to form a deviated bore such that the trajectory of the bore is not vertical; rather, the trajectory deviates from vertical along one or more portions of the bore. As an example, consider a target that is located at a lateral distance from a surface location where a rig may be stationed. In such an example, drilling may commence with a vertical portion and then deviate from vertical such that the bore is aimed at the target and, eventually, reaches the target. Directional drilling may be implemented where a target may be inaccessible from a vertical location at the surface of the Earth, where material exists in the Earth that may impede drilling or otherwise be detrimental (e.g., consider a salt dome, etc.), where a formation is laterally extensive (e.g., consider a relatively thin yet laterally extensive reservoir), where multiple bores are to be drilled from a single surface bore, where a relief well is desired, etc.

One approach to directional drilling involves a mud motor; noting that a mud motor may present some challenges depending on factors such as rate of penetration (ROP), transferring weight to a bit (e.g., weight on bit, WOB) due to friction, etc. A mud motor may be a positive displacement motor (PDM) that operates to drive a bit during directional drilling. A PDM operates as drilling fluid is pumped through it where the PDM converts hydraulic power of the drilling fluid into mechanical power to cause the bit to rotate. A PDM may operate in a so-called sliding mode, when the drillstring is not rotated from the surface.

An RSS may drill directionally where there is continuous rotation from surface equipment, which may alleviate the sliding of a steerable motor (e.g., a PDM). An RSS may be deployed when drilling directionally (e.g., deviated, horizontal, or extended-reach wells). An RSS may aim to minimize interaction with a borehole wall, which may help to preserve borehole quality. An RSS may aim to exert a relatively consistent side force akin to stabilizers that rotate with the drillstring or orient the bit in the desired direction while continuously rotating at the same number of rotations per minute as the drillstring.

The LWD module 254 may be housed in a suitable type of drill collar and may contain one or a plurality of selected types of logging tools (e.g., NMR unit or units, etc.). It will also be understood that one or more LWD and/or MWD modules may be employed at one or more positions. An LWD module may include capabilities for measuring, processing, and storing information, as well as for communicating with the surface equipment. In the illustrated example, the LWD module 254 may include a seismic measuring device, an NMR measuring device, etc.

The MWD module 256 may be housed in a suitable type of drill collar and may contain one or more devices for measuring characteristics of the drillstring 225 and the drill bit 226. As an example, the MWD module 256 may include equipment for generating electrical power, for example, to power various components of the drillstring 225. As an example, the MWD module 256 may include the telemetry equipment 252, for example, where the turbine impeller may generate power by flow of the mud; it being understood that other power and/or battery systems may be employed for purposes of powering various components. As an example, the MWD module 256 may include one or more of the following types of measuring devices: a weight-on-bit measuring device, a torque measuring device, a vibration measuring device, a shock measuring device, a stick slip measuring device, a direction measuring device, and an inclination measuring device.

As an example, one or more NMR measuring devices (e.g., NMR units, etc.) may be included in a drillstring (e.g., a BHA, etc.) where, for example, measurements may support one or more of geosteering, geostopping, trajectory optimization, etc. As an example, motion characterization data may be utilized for control of NMR measurements (e.g., acquisition, processing, quality assessment, etc.).

FIG. 2 also shows some examples of types of holes that may be drilled. For example, consider a slant hole 272, an S-shaped hole 274, a deep inclined hole 276 and a horizontal hole 278.

As an example, a drilling operation may include directional drilling where, for example, at least a portion of a well includes a curved axis. For example, consider a radius that defines curvature where an inclination with regard to the vertical may vary until reaching an angle between about 30 degrees and about 60 degrees or, for example, an angle to about 90 degrees or possibly greater than about 90 degrees. As an example, a trajectory and/or a drillstring may be characterized in part by a dogleg severity (DLS), which may be a two-dimensional parameter specified in degrees per 30 meters (e.g., or degrees per 100 feet).

As an example, a directional well may include several shapes where each of the shapes may aim to meet particular operational demands. As an example, a drilling process may be performed on the basis of information as and when it is relayed to a drilling engineer. As an example, inclination and/or direction may be modified based on information received during a drilling process.

As an example, deviation of a bore may be accomplished in part by use of a downhole motor and/or a turbine. As to a motor, consider a drillstring that may include a positive displacement motor (PDM).

As an example, a system may be a steerable system and include equipment to perform a method such as geosteering. As mentioned, a steerable system may be or include an RSS. As an example, a steerable system may include a PDM and/or a turbine on a lower part of a drillstring which, just above a drill bit, a bent sub may be mounted. Geosteering equipment of a drillstring may include one or more geosteering actuators that may provide for orienting a drill bit of the drillstring. For example, an actuator that may include a piston that moves a pad for providing a force that may be exerted against a borehole wall thus steering a bottom hole assembly (e.g., orienting a drill bit of the bottom hole assembly). As an example, an actuator may be a bent downhole motor, which may be actuated via one or more processes. As an example, a bent drilling motor may be used with a fixed bend that cannot be varied during normal operation or with a variable bend that, for example, may be varied based on a geosteering command. As an example, for a variable bend drilling motor, one or more actuators may be included that may be configured to create or vary a bend, thereby affecting the steering behavior of the steering system. As an example, an actuator may be a downhole actuator that may adjust orientation downhole and/or an actuator may be a surface actuator that may perform an action uphole (e.g., at surface) to adjust orientation downhole.

As an example, above a PDM, MWD equipment that provides real time or near real time data of interest (e.g., inclination, direction, pressure, temperature, real weight on the drill bit, torque stress, etc.) and/or LWD equipment may be installed. As to the latter, LWD equipment may make it possible to send to the surface various types of data of interest, including for example, geological data (e.g., gamma ray log, resistivity, density and sonic logs, etc.).

The coupling of sensors providing information on the course of a well trajectory, in real time or near real time, with, for example, one or more logs characterizing the formations from a geological viewpoint, may allow for implementing a geosteering method. Such a method may include navigating a subsurface environment, for example, to follow a desired route to reach a desired target or targets.

As an example, a drillstring may include one or more of an azimuthal density neutron (ADN) tool for measuring density and porosity; a MWD tool for measuring inclination, azimuth and shocks; a compensated dual resistivity (CDR) tool for measuring resistivity and gamma ray related phenomena; a combinable magnetic resonance (CMR) tool for measuring properties (e.g., relaxation properties, etc.); one or more variable gauge stabilizers; one or more bend joints; and a geosteering tool, which may include a motor and optionally equipment for measuring and/or responding to one or more of inclination, resistivity and gamma ray related phenomena.

As an example, a tool such as the ECOSCOPE tool (SLB, Houston, Texas) may be utilized to acquire measurements. Such a tool may include one or more PNGs and associated detectors. Such a tool may include features for one or more of resistivity, neutron porosity, azimuthal gamma ray, density, elemental capture spectroscopy and sigma measurements. For example, consider features for one or more of 2 MHz and 400 kHz propagation resistivity, elemental capture spectroscopy, neutron-gamma density, capture cross section (sigma), azimuthal bulk density, azimuthal photoelectric factor, azimuthal natural gamma ray, density caliper, ultrasonic caliper, annular pressure and temperature while drilling, triaxial shocks and vibration, and near-bit borehole inclination. Such a tool may be operatively coupled to one or more telemetry systems that may provide for real-time acquisition and, for example, real-time decision making, rendering of graphics, etc. As an example, such a tool may be operatively coupled to one or more types of circuitries, which may, for example, perform computations downhole using measurements acquired downhole.

As an example, a tool such as the PERISCOPE tool (SLB, Houston, Texas) may be utilized to acquire measurements. For example, consider measurements such as resistivity, which may be acquired using one or more types of receivers. As an example, a receiver may be or include an antenna. For example, the PERISCOPE tool may include tilted, axial, and transverse antenna. As an example, data acquired from such a tool may provide for identification of layers, number of layers, position of a layer or layers, within a distance of 1 meter or more (e.g., up to or more than 8 meters).

As to sigma measurements (e.g., sigma data), sigma is the macroscopic cross section for the absorption of thermal neutrons, or capture cross section, of a volume of matter, measured in capture units (c.u.). A sigma log is the principal output of a pulsed neutron capture log, which may be used for one or more purposes.

As an example, one or more types of nuclear measurements may be acquired by one or more tools where such nuclear measurements may include one or more of electron density ($\rho_e$), hydrogen index (HI), and thermal neutron capture cross section (sigma or $\Sigma$).

As an example, geosteering may include intentional directional control of a wellbore based on results of downhole geological logging measurements in a manner that aims to keep a directional wellbore within a desired region, zone (e.g., a pay zone), etc. As an example, geosteering may include directing a wellbore to keep the wellbore in a particular section of a reservoir, for example, to minimize gas and/or water breakthrough and, for example, to maximize economic production from a well that includes the wellbore.

Referring again to FIG. 2, the wellsite system 200 may include one or more sensors 264 that are operatively coupled to the control and/or data acquisition system 262. As an example, a sensor or sensors may be at surface locations. As an example, a sensor or sensors may be at downhole locations. As an example, a sensor or sensors may be at one or more remote locations that are not within a distance of the order of about one hundred meters from the wellsite system 200. As an example, a sensor or sensors may be at an offset wellsite where the wellsite system 200 and the offset wellsite are in a common field (e.g., oil and/or gas field).

As an example, one or more of the sensors 264 may be provided for tracking pipe, tracking movement of at least a portion of a drillstring, etc.

As an example, the system 200 may include one or more sensors 266 that may sense and/or transmit signals to a fluid conduit such as a drilling fluid conduit (e.g., a drilling mud conduit). For example, in the system 200, the one or more sensors 266 may be operatively coupled to portions of the standpipe 208 through which mud flows. As an example, a downhole tool may generate pulses that may travel through the mud and be sensed by one or more of the one or more sensors 266 (e.g., consider mud-pulse telemetry). In such an example, the downhole tool may include associated circuitry such as, for example, encoding circuitry that may encode signals, for example, to reduce demands as to transmission. As an example, circuitry at the surface may include decoding circuitry to decode encoded information transmitted at least in part via mud-pulse telemetry. As an example, circuitry at the surface may include encoder circuitry and/or decoder circuitry and circuitry downhole may include encoder circuitry and/or decoder circuitry. As an example, the system 200 may include a transmitter that may generate signals that may be transmitted downhole via mud (e.g., drilling fluid) as a transmission medium.

Analysis of formation information acquired by one or more tools may reveal features such as, for example, vugs, dissolution planes (e.g., dissolution along bedding planes), stress-related features, dip events, etc. As an example, a tool may acquire information that may help to characterize a reservoir, optionally a fractured reservoir where fractures may be natural and/or artificial (e.g., hydraulic fractures). A reservoir may be a porous formation where fluid may be within various pores of the porous formation and amenable to movement (e.g., to produce fluid from the reservoir). As an example, information acquired by a tool or tools may be analyzed using a framework such as the TECHLOG framework (SLB, Houston, Texas). As an example, the TECHLOG framework may be interoperable with one or more other frameworks such as, for example, the PETREL framework (SLB, Houston, Texas). As an example, a computational environment such as, for example, the DELFI environment (SLB, Houston, Texas) may be utilized, which may provide for utilization of the PETREL framework and other frameworks, optionally in interrelated manners.

Figure 3:
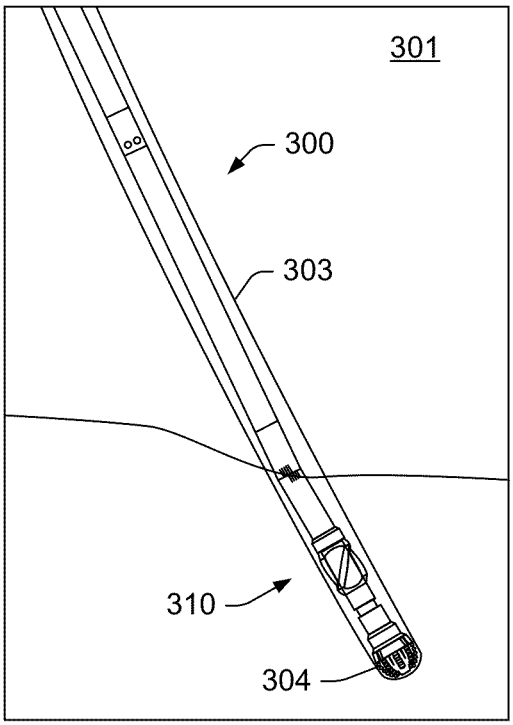
FIG. 3 illustrates an example of a geologic environment with a borehole and an example of a portion of a drillstring that may include various components.
Figure 3:
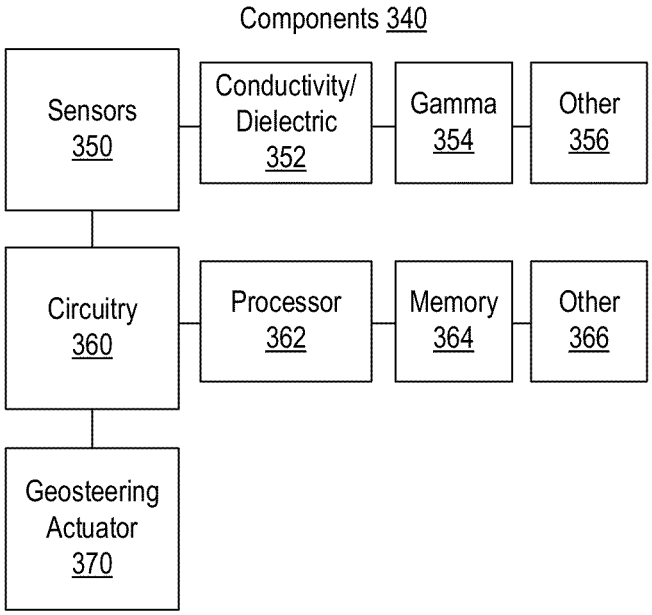
Figure 3:
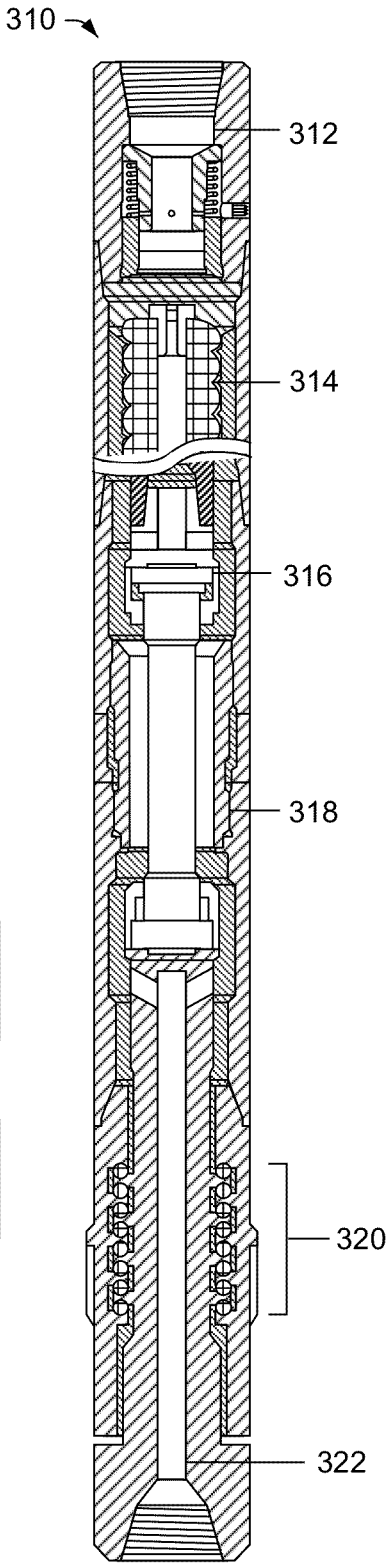

FIG. 3 shows an example of a drilling assembly 300 in a geologic environment 301 that includes a borehole 303 where the drilling assembly 300 (e.g., a drillstring) includes a bit 304 and a motor section 310 where the motor section 310 may drive the bit 304 (e.g., cause the bit 304 to rotate and deepen the borehole 303).

As shown, the motor section 310 may include a dump valve 312, a power section 314, a surface-adjustable bent housing 316, a transmission assembly 318, a bearing section 320 and a drive shaft 322, which may be operatively coupled to a bit such as the bit 304. The motor section 310 of FIG. 3 may be a POWERPAK family motor section (SLB, Houston, Texas) or another type of motor section.

A power section may convert hydraulic energy from drilling fluid into mechanical power to turn a bit. For example, consider the reverse application of the Moineau pump principle. During operation, drilling fluid may be pumped into a power section at a pressure that causes the rotor to rotate within the stator where the rotational force is transmitted through a transmission shaft and drive shaft to a bit.

FIG. 3 also shows examples of components 340 such as, for example, sensors 350, circuitry 360 and a geosteering actuator 370. As shown, the sensors 350 may include a conductivity and dielectric sensor 352, a gamma sensor 354 and one or more other sensors 356. As shown, the circuitry 360 may include a processor 362, memory 364 and one or more other types of circuitries 366. As shown, the geosteering actuator 370 may be operatively coupled to the circuitry 360 and the sensors 350. For example, the circuitry 360 may process signals (e.g., measurements or sensor data) of the sensors 350 to generate one or more commands for actuation of the geosteering actuator 370. In the example of FIG. 3, the geosteering actuator 370 may provide for one or more of PDM actuation and bent sub actuation, for example, to orient the drill bit 304.

Figure 4:
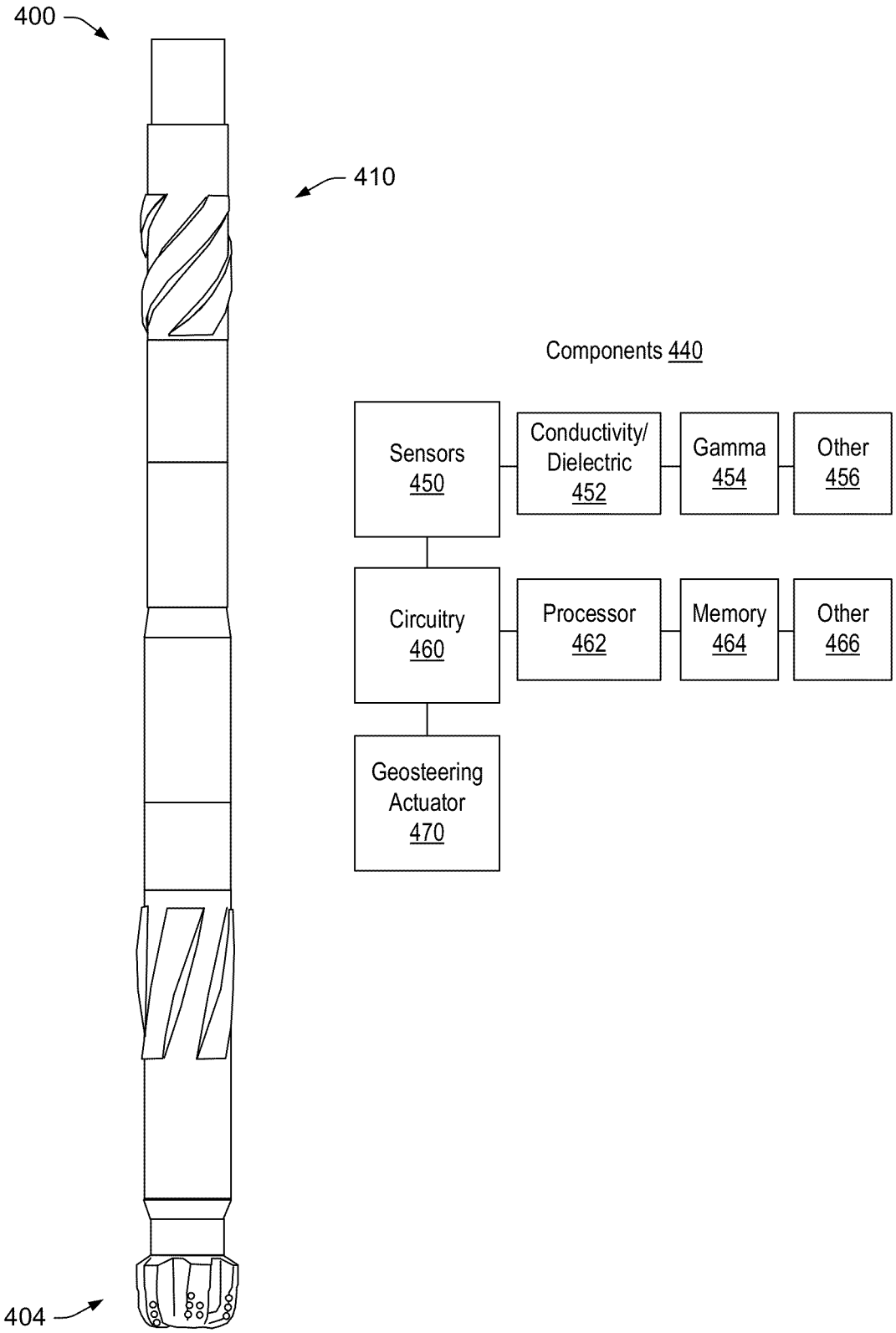
FIG. 4 illustrates an example of a portion of a drillstring that may include various components.

FIG. 4 shows an example of a drilling assembly 400 (e.g., a portion of a drillstring) that includes a bit 404 and a rotary steerable system (RSS) 410. As mentioned, an RSS may be utilized for directional drilling, including geosteering. As an example, the RSS 410 may include one or more features of a POWERDRIVE ARCHER RSS (SLB, Houston, Texas).

FIG. 4 also shows examples of components 440 such as, for example, sensors 450, circuitry 460 and a geosteering actuator 470. As shown, the sensors 450 may include a conductivity and dielectric sensor 452, a gamma sensor 454 and one or more other sensors 456. As shown, the circuitry 460 may include a processor 462, memory 464 and one or more other types of circuitries 466. As shown, the geosteering actuator 470 may be operatively coupled to the circuitry 460 and the sensors 450. For example, the circuitry 460 may process signals (e.g., measurements or sensor data) of the sensors 450 to generate one or more commands for actuation of the geosteering actuator 470. In the example of FIG. 4, the geosteering actuator 470 may provide for RSS actuation, for example, to orient the drill bit 404.

As an example, the drilling assembly 400 may include one or more of a near-bit continuous inclination and azimuth measurement unit or sub, a near-bit azimuthal gamma ray measurement unit or sub, and one or more other types of measurement units or subs.

As an example, a drilling assembly may include one or more types of circuitries. For example, consider a processing unit with a processor and associated memory where one or more sensors may generate signals that may be received by the processing unit. In such an example, the processing unit may perform computations that may utilize information in the signals (e.g., measurements, etc.) to generate commands for geosteering. In such an example, a drilling assembly may be capable of performing, at least in part, downhole geosteering according to geosteering commands generated downhole without transmission of information uphole to a controller and subsequent transmission of information downhole to geosteering equipment. In such an example, at least some types of geosteering processes may be performed more rapidly in response to sensor signals. For example, consider sensor signals indicative of one or more of presence of clay, an amount of clay, a type of clay, and a boundary as an interface between layers, where downhole geosteering equipment may act to steer a drill bit based on one or more of such sensor signals.

As an example, an electromagnetic conductivity measurement tool (ECM tool) may be implemented as a wireline tool and/or implemented as a LWD tool to generate permittivity and conductivity measurements at each frequency for one or more frequencies, which may be interpreted using a petrophysical model. In such an example, output parameters of the model may include water-filled porosity (hence water saturation if the total porosity is known) and water salinity. As an example, parameters that may be output using ECM tool measurements (e.g., induction, propagation, etc.) may include one or more of bulk formation cation exchange capacity (CEC), water saturation ($S_w$), connate water salinity, Archie cementation exponent and Archie saturation exponent.

Figure 5:
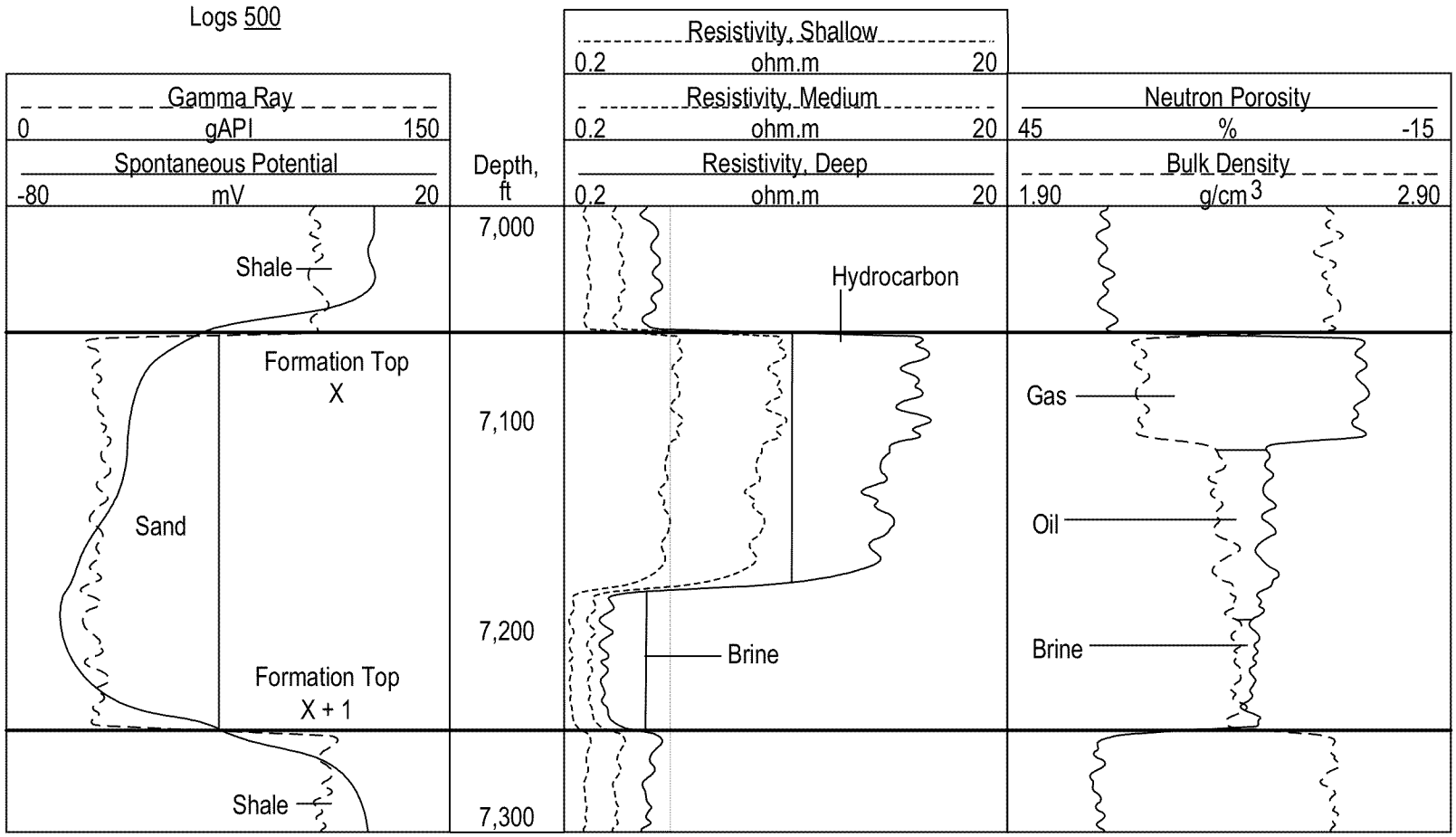
FIG. 5 illustrates examples of logs.

FIG. 5 shows example logs 500 that include various measurements acquired by one or more downhole tools. For example, the logs 500 include spontaneous potential (mV), gamma ray (gAPI), resistivity (ohm·m), neutron porosity (percent), and bulk density ($g \cdot cm^3$). The gamma ray response (track 1) distinguishes the low gamma ray value of sand from the higher value of shale. The spontaneous potential curve generally follows a trend similar to that of the gamma ray. The next column, referred to as a depth track (track 2), indicates the depth at which measurements have been acquired. Across the sandstone formation, the resistivity measurements (track 3) are noticeably higher in the hydrocarbon zone than in the water-saturated zone in the lower part of the sand. Both neutron porosity and bulk density (track 4) provide measures of porosity. Within the hydrocarbon-bearing zone, the separation of the curves varies depending on the type of fluid encountered.

As an example, logs may be acquired as to formation parameters versus depth where, from such logs, lithologies may be identified that may differentiate various type of rock. For example, consider differentiating between porous and nonporous rock, which may provide for identification of one or more pay zones in subsurface formations. In a given field or local geological province, certain formations may have distinctive characteristics that appear similar from one well to the next, providing geologists with a basis for locating the depths of various strata in the subsurface. For example, consider identification of formation tops, which may be tracked from logs of one well to logs of another well. In the example of FIG. 5, the logs 500 include variations with respect to shale and sand where a first interface may be referred to as formation top X and a second interface may be referred to as formation top X+1. In such an example, an interface may be referred to as a boundary, which may also be identifiable in one or more other types of data such as, for example, seismic data. As an example, a workflow may include correlation of seismic picks to geologic picks, such as formation tops interpreted from well logs, to improve model building, etc.

In 1942, the relationship between resistivity, porosity and water saturation (and thus its inverse: hydrocarbon saturation) was established by G.E. Archie, paving the way for a quantitative evaluation of formation properties using well logs. The Archie equation or relationship may be expressed between the formation factor (F) and porosity (phi) as $F=1/phi^m$, where the porosity exponent, m, is a constant for a particular formation or type of rock, which may be referred to as the Archie cementation exponent (e.g., consider values between 1.8 and 2.0 for consolidated sandstones, and close to 1.3 for loosely consolidated sandstones).

As to resistivity of rock, it is a measure of the degree to which rock may impede the flow of an electric current. As shown, resistivity may be expressed in units of ohm·m, noting that it may be measured in $ohm \cdot m^2/m$. The reciprocal of resistivity is conductivity, which is typically expressed in terms of millimhos or mmhos. The ability to conduct electrical current is a function of the conductivity of water contained in pore space of rock. Pure water does not conduct electricity; whereas, salt ions found in most formation waters do provide for conduction of electricity. Brine-saturated rocks tend to have high conductivity and low resistivity, which may be seen in the resistivity log data of FIG. 5 at depths about 7,200 feet. Hydrocarbons, which are nonconductive, cause resistivity values to increase as the pore spaces within a rock become more saturated with oil or gas.

As to spontaneous potential (SP), it is a measurement of voltage difference between a movable electrode in a wellbore and a fixed electrode at the surface. This electrical potential is primarily generated as a result of exchanges of fluids of different salinities (e.g., salinity of drilling fluid and salinity of formation fluid). During the course of drilling, permeable rock within a wellbore may become invaded by drilling mud filtrate where, if the filtrate is less saline than formation fluid, negatively charged chlorine ions from formation water may cause the SP curve to deflect to the left from an arbitrary baseline established across impermeable shale formations. The magnitude of the deflection is influenced by a number of factors, including permeability, porosity, formation water salinity and mud filtrate properties. Permeable formations filled with water that is fresher than the filtrate will cause the curve to deflect to the right. Hence, by the nature of deflections, an SP log may indicate which formations are permeable. A permeable formation with a high resistivity may be more likely to contain hydrocarbons.

As shown in the logs 500, a gamma ray (GR) log may be included, along with one or more of multiple resistivity logs and porosity readings obtained from density, neutron, and/or sonic logs. As to GR log acquisition, a downhole tool may measure naturally occurring radioactivity from a formation where a GR log may help differentiate non-reservoir rocks (e.g., shales and clays) from reservoir rocks (e.g., sandstone and carbonates). Shales and clays tend to be derived from rocks that tend to contain naturally occurring radioactive elements, primarily potassium, uranium and thorium. As a consequence, shales and clays are more radioactive than clean sandstones and carbonates. Quartz and calcium carbonate produce almost no radiation. A log analysis may look for formations with low background radiation because they may have potential to contain moveable hydrocarbons.

Various resistivity tools may measure a formation at different depths of investigation (e.g., shallow, medium and deep). A resulting log may present shallow, medium and deep tracks. A shallow curve, charting the smallest radius of investigation, may indicate resistivity of a flushed zone surrounding a borehole; a medium curve may indicate resistivity of an invaded zone; and a deepest curve may indicate resistivity of an uncontaminated zone, which may be presumed to be a true formation resistivity; noting that such a curve may still be affected by the presence of mud filtrate. By evaluating separations between curves at different depths of investigation, an analysis may provide an estimation of a diameter of invasion by mud filtrate and may be able to determine which zones are more permeable than others.

As to formation bulk density, it provides a measure of porosity. The bulk density of a formation is based on a ratio of a measured interval's mass to its volume. In general, rock porosity tends to be inversely related to rock density. Formation bulk density may be derived from electron density of a formation. Such a measurement may be obtained by a logging device that emits gamma rays into a formation. Gamma rays may collide with electrons in a formation, giving off energy and scattering in a process known as Compton scattering. The number of such collisions is directly related to the number of electrons in a formation. In low-density formations, more of these scattered gamma rays are able to reach a detector than in formations of higher density.

As hydrogen tends to be a major constituent of both water and hydrocarbons and because water and hydrocarbons concentrate in rock pores, the concentration of hydrogen atoms may be used to determine fluid-filled porosity of a formation. Hydrogen atoms have nearly the same mass as neutrons. Neutron logging tools emit neutrons using a chemical source or an electronic neutron generator. When these neutrons collide with hydrogen atoms in a formation, they lose the maximal energy, slow down and eventually reach a very-low-energy state (e.g., a thermal state). The rate at which neutrons reach the thermal state is proportional to the hydrogen concentration or index (HI). Various neutron porosity tools measure HI, which may be converted to neutron porosity.

As an example, a sonic log may be used to determine porosity by charting the speed of a compressional sound wave as it travels through a formation. Interval transit time ($\Delta t$), measured in microseconds per meter or foot and often referred to as slowness, is the reciprocal of velocity. Lithology and porosity affect $\Delta t$. Dense, consolidated formations characterized by compaction at depth generally result in a faster (shorter) $\Delta t$ while fluid-filled porosity results in a slower (longer) $\Delta t$. Measurements may be affected by formation and borehole conditions. In various instances, quality control processes may be performed on data. As an example, gas, fractures and lack of compaction may demand adjustments to be applied to a sonic log. Lithologies affect the density, neutron and sonic logs. Invasion of mud filtrate into porous formations affects resistivity readings, and temperature affects the resistivity of both filtrate and saline formation water.

As an example, a framework may provide for performing log correlation in geosteering before landing using one or more machine learning models. In such an example, the framework may provide for automatically identifying formation tops, which may be referred to as well tops, in a number of target wells. As an example, data from one or more offset wells may be utilized to facilitate identification of formation tops in a target well, which may be a well that is being drilled using direction drilling equipment that may perform geosteering. In such an example, geosteering may aim to drill into a particular formation and to maintain a borehole within that particular formation.

As an example, directional drilling may involve drilling a number of different sections such as, for example, a build section, a landing section and a lateral section. In such an example, a build section may be a portion of a directional wellbore curve that may extend from a kick-off point (KOP) to another point. As to a landing section, it may be a portion of a wellbore beyond a build section where steering may be controlled in an effort to hit a target. A landing section may be composed of segments such as, for example, an upper segment, which may be referred to as an approach section, and a lower segment, which may be referred to as a taper section. In the approach section, the magnitude of changes may tend to be greater than in the taper section as the taper section may aim to form a wellbore that smoothly transition at the end of the landing as the drillstring enters a target zone (e.g., a target formation). As to a lateral section, it may be a portion of a wellbore that extends substantially horizontally from an end of a landing taper, out to an end of the wellbore. A course change within a lateral section may affect a reservoir for better or for worse. As an example, a lateral section may be drilled using a BHA, which may include a mud motor, an RSS, etc. In various scenarios, inclination and/or azimuth of a lateral section may be maintained through a combination of sliding and rotating of a drillstring.

As an example, directional drilling may include geosteering as part of a landing job (e.g., drilling a landing section). In a landing job for a well, estimated well tops in the current well may lack accuracy. For example, estimated well tops may be rough estimates based on data from one or more offset wells as may be visually assessed by one or more individuals. As explained, a drillstring may include one or more logging tools to acquire measurements while drilling (e.g., MWD, LWD, etc.). Thus, when a current well is being drilled, real-time log measurements may be acquired. Where such measurements are available, an assessment may involve performing a comparison of a current well's log data and log data from one or more other wells (e.g., log data from one or more offset wells) to generate a more accurate estimate of one or more well tops. Such an assessment may be referred to as log correlation during geosteering. During directional drilling, accurate estimation of well tops may provide for decision making. For example, consider decision making as to whether drilling has arrived one or more points along a trajectory (e.g., planned trajectory points, safety points, etc.). In various instances, a point may be associated with an operation (e.g., a downhole operation, etc.) that is to be performed. During a landing job, a decision may relate to termination of a landing section or a transition from one landing segment to another.

As explained, directional drilling may involve performing log correlation visually, for example, using a number of logs rendered to a display. In such an example, one or more well placement engineers may interact with a graphical user interface that may provide for rendering logs to a display and manually adjusting positions of logs with respect to one another, picking well tops, etc.

Figure 6:
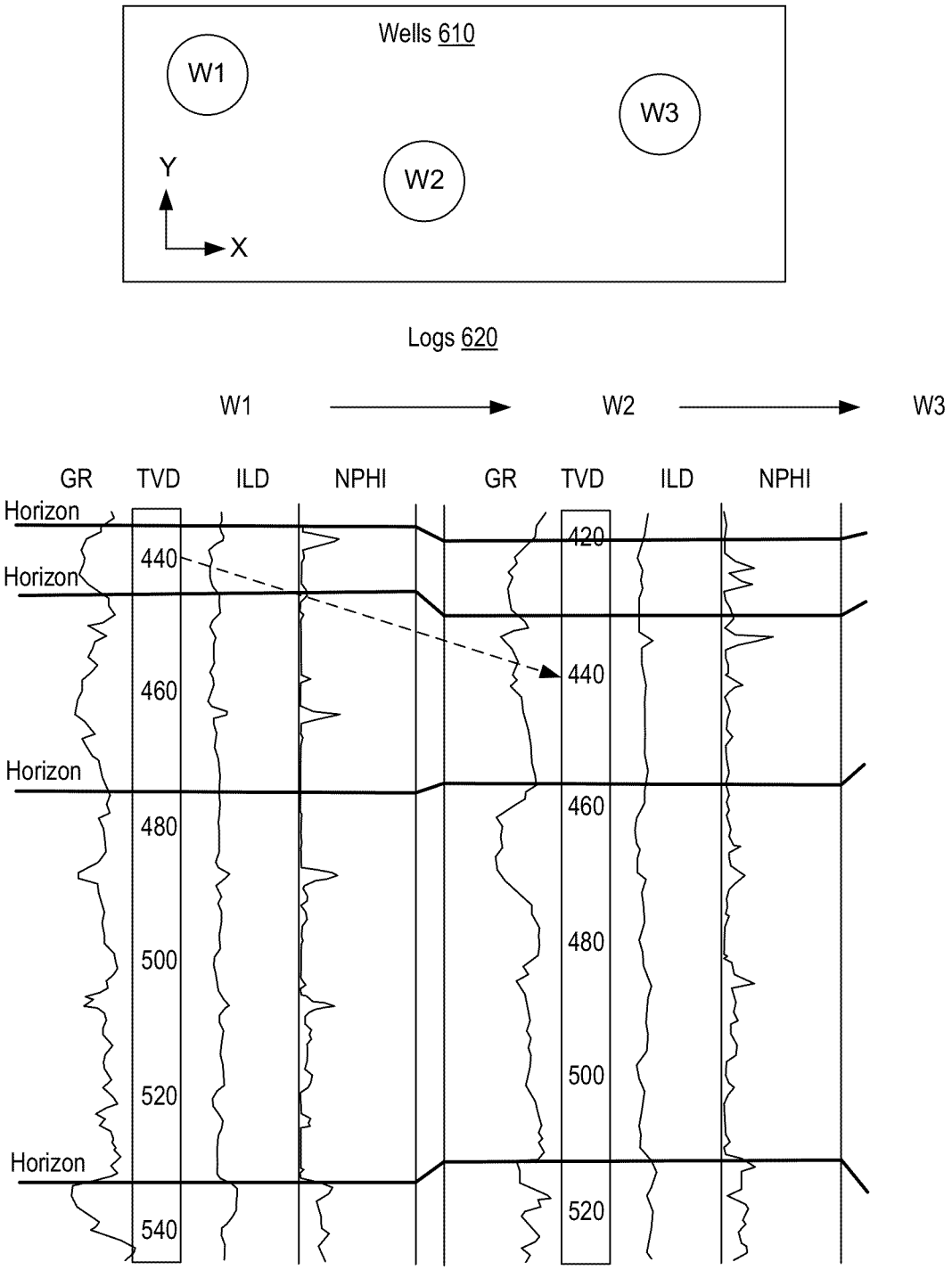
FIG. 6 illustrates examples of wells and log correlation.

FIG. 6 shows an example of a plan view of a region that includes a number of wells 610, labeled W1, W2, and W3, at different X, Y positions, which may be at different elevations. As shown, logs 620 may be rendered to a display where horizons may be identified for each well and tracked from one well to another. A horizon may be an interface between formations such as, for example, a formation top (e.g., a well top). In the example of FIG. 6, one of the wells may be a current well while other wells may be considered to be offset wells. During drilling an operator may aim to correlate data acquired from the current well to data for the offset wells to help understand where various layers are positioned with respect to the current well. As shown, layers may be defined by one or more horizons. As the layers may not be parallel to a surface and as a surface may not be horizontal, the horizons may vary with respect to true vertical depth (TVD). For example, consider the shift in TVD from 440 for W1 and 440 for W2, noting that the second horizon is at a TVD in W1 that is deeper than a TVD for the second horizon in W2. Hence, within a field, a horizon may vary with respect to its TVD. As shown, the example logs 620 may include gamma ray (GR), resistivity (e.g., induction resistivity, ILD) and porosity logs (e.g., neutron porosity, NPHI). As to resistivity, a medium investigation log may be labeled as induction log medium (ILM) while a deeper investigation log may be labeled as induction log deep (ILD), which may provide values close to the true resistivity of an undisturbed formation layer.

Figure 7:
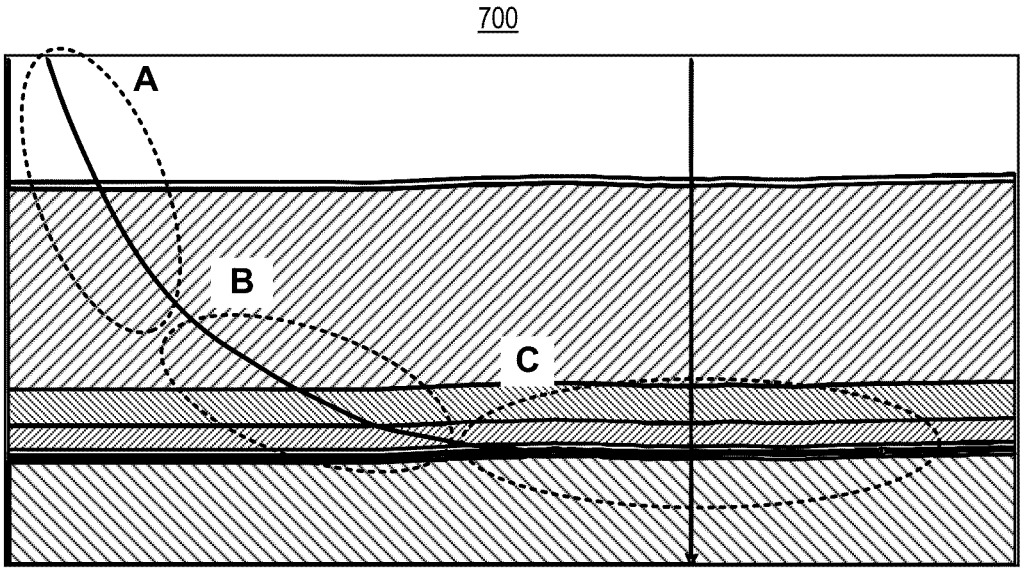
FIG. 7 illustrates an example of a subsurface environment.

FIG. 7 shows an example of a subsurface environment 700 that includes a wellbore, which may be a planned wellbore, a partially drilled wellbore or a drilled wellbore. As explained, directional drilling may involve drilling of various sections, which may include a build section, a landing section and a lateral section. In the example of FIG. 7, during drilling of the build section (see section labelled A), a framework may provide for generating correlations for the wellbore using offset well data and acquired data for the wellbore in an effort to tie into geology of the build section; during drilling of the landing section (see section labelled B), a framework may provide for generating correlations for the wellbore using offset well data and acquired data for the wellbore for predicting a suitable landing point of the landing section; and, during drilling of the lateral section (see section labelled C), a framework may provide for generating correlations for the wellbore using offset well data and acquired data for the wellbore for steering to maintain a wellbore within a desirable target zone (e.g., a reservoir zone).

As explained, log correlation tends to be performed manually by well placement engineers, which may introduce inconsistencies, latencies, etc., during drilling. As an example, a framework may implement one or more machine learning (ML) models that may automatically predict a position of a formation top during drilling, for example, responsive to receipt of data acquired by a downhole tool string (e.g., a drill string, etc.). By implementation of such a framework, well placement engineers may gain confidence in drilling operations and may be provided with time that may allow for performance of other tasks. As an example, an ML model-based approach may provide for consistency in results for drilling operations of a well or wells. As an example, an ML model-based approach may provide for continuous learning, re-training, etc., such that a framework may improve output responsive to acquisition of data (e.g., during a drilling job, etc.). As explained, a drilling job may include drilling of a landing section that relies on a landing point. As an example, a framework may provide for achieving higher accuracy and consistency than a human-based approach, particularly, in ambiguous cases, to improve landing point determinations.

Figure 8:
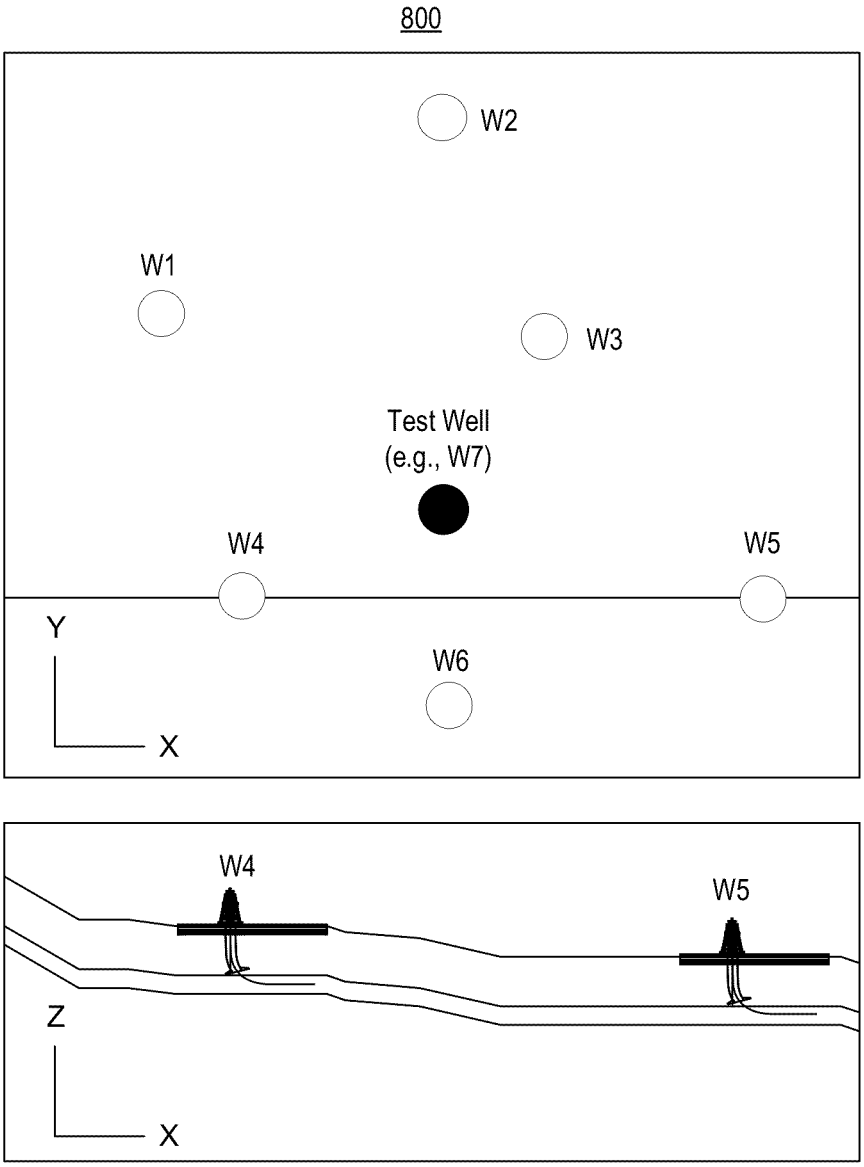
FIG. 8 illustrates an example of a map of well locations.

FIG. 8 shows an example of a map 800 of a group of wells as test well and offset wells for purposes of training one or more ML models. As shown, the map 800 may include a plan view (e.g., in X and Y) and a depth view (e.g., in X and Z or Y and Z). As an example, a group may include a number of wells such as, for example, more than 5 wells and less than 10 wells where, for example, one of the wells may be selected as a test well while others may be selected as training wells (e.g., offset wells). As shown in the example of FIG. 8, wells may be at different surface locations, which may vary as to level above or below a reference (e.g., sea level). In the example of FIG. 8, seven wells are shown (labeled W1 to W7) where the well labeled W7 may be a test well while the other wells W1 to W6 may be considered offset wells.

Figure 9:
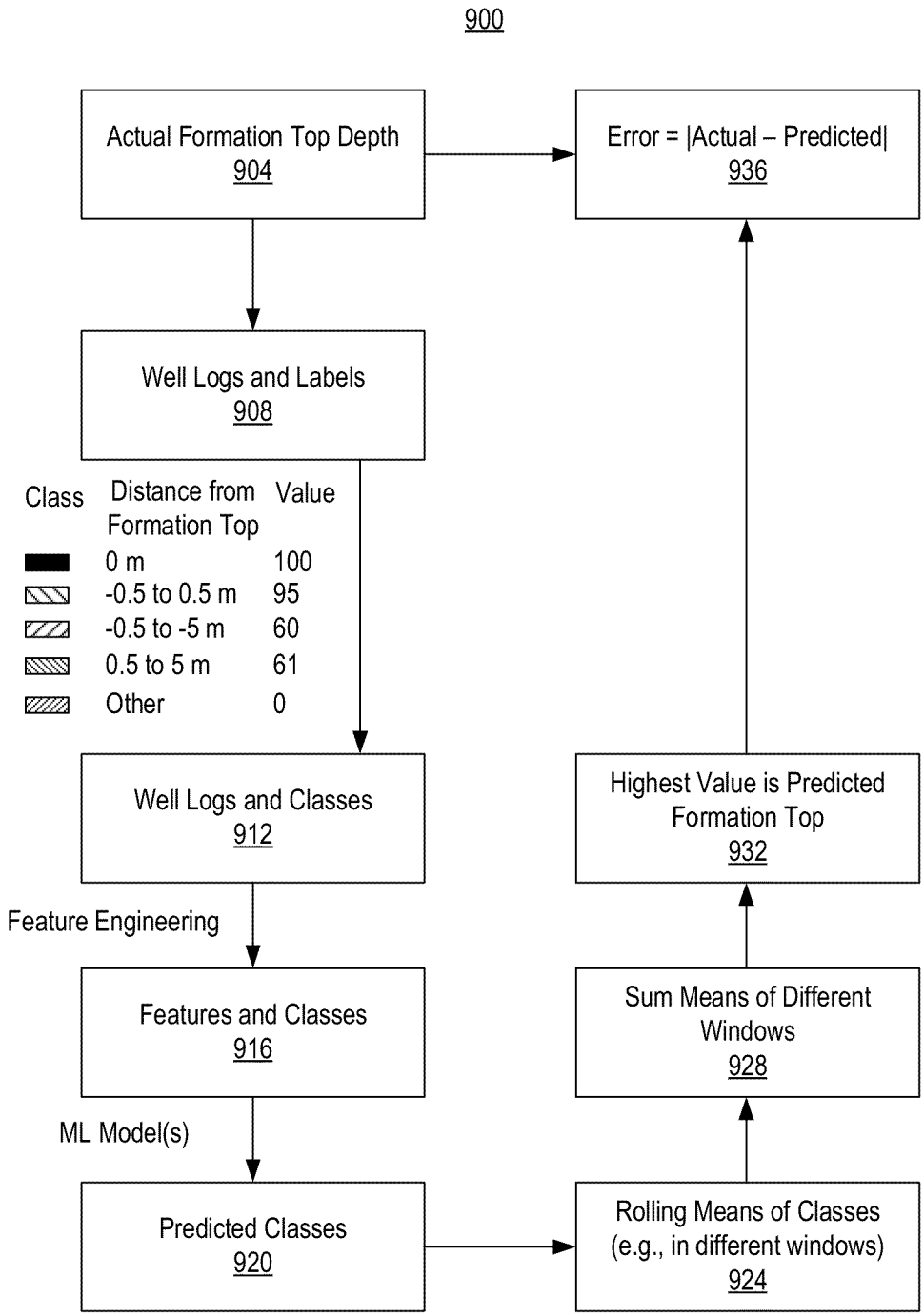
FIG. 9 illustrates an example of a workflow.

FIG. 9 shows an example of a workflow 900 that may provide for generation of one or more ML models that may be utilized to predict a position of a formation top such as, for example, a TVD value of a formation top based at least in part on data acquired during drilling. As shown in the example of FIG. 9, the workflow 900 may include a reception block 904 for receiving an actual formation top depth (e.g., TVD of a formation top), a labeling block 908 for accessing well logs and labeling the well logs, a classification block 912 for generating classes for the well logs and their labels, a feature engineering block 916 for generating features for classes, a machine learning block 920 for predicting classes using one or more machine learning (ML) models, a statistic block 924 for computing rolling means of classes (e.g., in different windows), a summation block 928 for summing means of different windows, a prediction block 932 for predicting a formation top based on a highest value of sums of means of different windows, and an error block 936 for computing an error as a difference between a position of the actual formation top and the position of the predicted formation top (e.g., an absolute value of a difference in TVD of the actual formation top and the predicted formation top).

As an example, a method may include accessing data from a number of offset wells where the data may be in the form of logs (e.g., tracks, curves, etc.) that may be sampled with respect to depth using a number of depth points as may be relevant to one or more formations (e.g., reservoir formations) in a particular field such as, for example, the field of the map 800 of FIG. 8.

As shown in the example workflow 900 of FIG. 9, a particular formation top (e.g., well top) may be selected (see, e.g., actual formation top) where classes may be defined. For example, consider defining classes based on distance from a selected formation top. As shown, classes may include a zero distance class that may be assigned a value of 100 points, a −0.5 m to 0.5 m distance class that may be assigned a value of 95 points, a −0.5 m to −5 m distance class that may be assigned a value of 60 points, a 0.5 m to 5 m distance class that may be assigned a value of 61 points, and an other distance class that may be assigned a value of 0 points.

In the example workflow 900 of FIG. 9, a feature engineering process may be performed that assesses various features that may be considered relevant features for increased prediction accuracy and/or consistency. Once a set of features have been determined through feature engineering, an ML model may be trained where, responsive to receipt of a set of features, the trained ML model may provide for outputting a prediction as to a position of a particular formation in a well that may be a current well that is being drilled. For example, consider a tree type of ML model such as a boosted tree model (e.g., consider XGBoost, etc.). As an example, more than one ML model may be utilized.

As shown in the workflow 900 of FIG. 9, a trained ML model may be utilized to predict classes along a distance range where the zero distance class may represent a predicted position of a formation top in a particular well. As explained, an ML model may receive a set of features (e.g., feature values, etc.) that may include one or more features that depend on data acquired during drilling of a particular well. In such an example, a predicted formation top position may be utilized as a marker to improve drilling of the particular well. In such an example, an ML model may be part of a framework that may provide for automated log correlation, that may or may not depend on human interaction. As an example, a human-in-the-loop (HITL) may be utilized to assure that a prediction is reasonable; noting that one or more automated quality control processes may be implemented to automatically assure that a prediction is reasonable for purposes of drilling (e.g., geosteering, etc.).

In the example workflow 900 of FIG. 9, a metric such as, for example, a sum of rolling means of classes may be utilized to predict a position of a formation top; noting that one or more statistics and/or statistical techniques may be utilized to determine a metric or metrics. Such a metric or metrics may be part of an ML model and/or may be part of a framework that operates on output of an ML model. As an example, a sum of rolling means of classes may be assessed as to a highest value where the highest value corresponds to the position of the formation top of interest. For example, as mentioned, the zero distance class may be assigned the highest value as to points such that the sum of rolling means of classes with the highest value is the closest to the zero distance class. As an example, a scoring scheme may be utilized where a zero distance class may be assigned a lowest value and hence a lowest value may be selected to predict a position of a formation top of interest.

Referring to the classes and point value scheme, this scheme may be engineered to improve model performance. For example, values may be selected along a range from 0 to 100 such that classes may be effectively weighted. As shown, different classes may be weighted closely (e.g., 60 versus 61) or weighted with a maximum difference (e.g., 100 versus 0).

As shown in the example workflow 900 of FIG. 9, an error may be determined such as an actual to predicted position error (e.g., consider an absolute value of a difference between two positions). As explained, an ML model may be improved (e.g., via re-training, etc.) through one or more metrics such as, for example, an error metric.

As explained, a workflow may include feature engineering utilizing various types of measurements (e.g., track, curve or log sets). For example, consider types of measurements presented in Table 1, below.

TABLE 1

Example Measurement Sets

| Rank | | Curve Sets for Modeling Offset Wells |
|---|---|---|
| 3 | Triple combination | ILD, ILM, Density, GR, N |
| 2 | Common for landings | ILD, GR |
| 5 | Unconventional | MSE, GR |
| 1 | Most complete | ILD, Density, GR, NPHI |
| 4 | All | ILD, ILM, Density, GR, DT, PE |
| 6 | Shallow reservoir | ILLD, ILM, ILS, Density, GR, N, DT, PE |

Table 1 shows a ranking of various curve sets for purposes of ML modeling. As shown, data may be available for various offset wells where such data may be associated with particular characteristics such as a shallow reservoir, an unconventional reservoir, data common for landings, etc. Such an approach may be utilized for multiwell correlation for one or more phases such as, for example, a pre-job phase and/or for landing phase. As an example, an ML model-based approach may be utilized prior to performing a job and/or during a drilling job.

In Table 1, the data may be from a field such as the field of the map 800 of FIG. 8 where, for example, a number of wells may be considered (e.g., consider a range from 2 wells to 8 wells). In such an approach, data may be split into training data and testing data. For example, consider data for one well being used at while drilling data, which may be used for testing, while data for other wells may be considered offset wells data, which may be used for training.

As an example, a workflow may include, based on well logs in offset wells, deriving features which may include some particular features to reflect statistical characteristics around well tops. Such statistical windows may cover different ranges to capture one or more of a local trend, a median trend and a global trend. In such an approach, to address data imbalance (e.g., more data for no well tops than data for well tops), class labels may be defined according to a distance metric with respect to an actual well top pick where, for example, a workflow may include down-sampling and up-sampling. As explained, a tree type of model may be utilized such as, for example, the XGBoost model. For example, a workflow may train an XGBoost model and finetune parameters to achieve desirably high accuracy. In such an approach, a concept such as multiple windows scanning may be implemented to make a final prediction more stable and more reliable. As explained, one or more quality control processes may be applied, for example, in the form of logic, etc., to generate a reasonable prediction list from probabilistic predictions from different well tops.

As explained, machine learning demands data for training, testing, etc. As explained, data may be imbalanced, which may impact utilization of machine learning. As to geosteering, data may be both limited and imbalanced. For example, as to a particular well to be drilled, there may be a limited amount of data such as, for example, data from less than ten wells that may be sufficiently relevant given proximity to the particular well to be drilled. While a machine learning approach may focus on large scale oil field application, where there are tens of, or even thousands of wells that may be used for training data, such a large number of wells may lack accuracy with respect to the demands for decision making during geosteering.

As mentioned, a framework may utilize one or more tree-based machine learning techniques, which may include techniques to handle series data (e.g., time and/or depth). As explained, a framework may provide for implementation of an automatic workflow to pick the well tops in one or more target wells. As an example, a framework may be operable for one or more rigs for drilling one or more wells. As explained, a framework may provide for performing automatic log correlation in geosteering, which may, for example, allow for one or more levels of automation as to auto-geosteering.

As explained, automation may reduce workload of geosteering engineers, reduced workload to allow reducing crews or to allow the same crews to cover more wells, and provide more consistent answers with less environmental impact.

Figure 10:
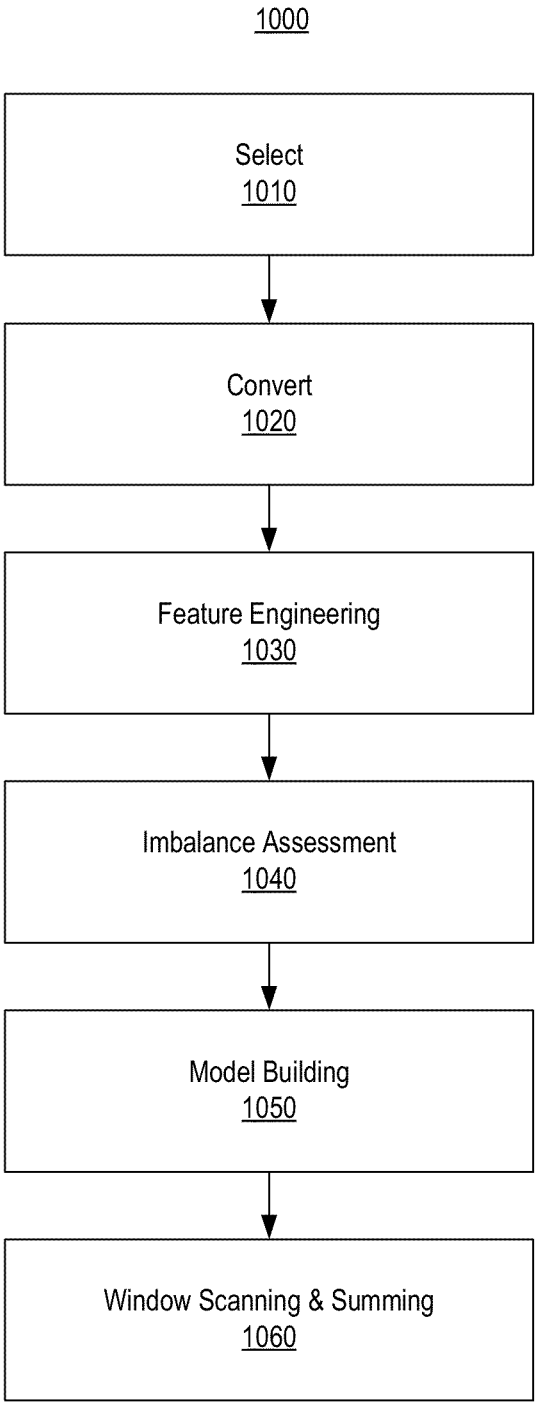
FIG. 10 illustrates an example of a workflow.

FIG. 10 shows an example of a workflow 1000 that may implement machine learning for log correlation in geosteering before landing. As shown, the workflow 1000 may include a selection block 1010 for selecting adjacent wells and well logs to be used for log correlation; a conversion block 1020 for converting the offset well data into a training dataset that may include some data preprocessing, such as, for example, log 10-based conversions for resistivity logs, denoising logs, and normalization of logs; a feature engineering block 1030 for performing feature engineering on the training dataset, including feature derivation from depths and some statistics within different depth windows on different logs, which may help to capture the characteristics of the log response in different scopes; an imbalance assessment block 1040 for handing data imbalance, which may involve, for example, defining a new label set {0, 60, 61, 95, 100}according to distance to a well top pick, where zero distance may have the label 100, 0.5 meters may be labeled as 95, 0.5 to 5 meters above may be labeled 61, 0.5 to 5 meters below may be labeled 60, and all others may be labeled 0, along with up-sampling for 100 and 95 labels with a factor of 50 and 10, respectively, and down-sampling for label 0 with a shrink factor of 10; a model building block 1050 for building an XGBoost model with optimized parameters to predict a label at each depth; and a window scanning and summing block 1060 for multi-windows scanning to sum up predicted labels within different depth window sizes where such an approach may sum up these sums together where the depth with the largest sum will be the predicted position of a well top. Such an approach may help to make a prediction more stable and reliable, for example, by confirming the prediction in different scales, which may help to reduce random error issues that may stem from a pure machine learning method.

As explained, windows may be utilized to increase prediction accuracy. For example, consider a method that may utilize three or more windows (e.g., from three to five windows, etc.). As an example, consider windows that may be varied using a formula such as Z, $Z^2$, $Z*Z^2$, etc. In such an example, where Z is equal to three, windows may be [3, 9, 21], which may provide a sufficient range of windows. As an example, Z may be given in feet or meters or according to a sampling metric (e.g., sampling rate, etc.). As an example, a framework may utilize a default setting; noting that windows may be selected and/or tailored based on evaluation of results for different locations (e.g., during a pre-job phase, etc.).

As an example, a framework may provide for rendering one or more graphical user interfaces (GUIs) that may provide for review of one or more predictions. For example, consider a GUI that may include a representation of a formation or formations where one or more boundaries (e.g., one or more formation tops) are indicated such that an individual may determine whether or not accuracy is sufficient for purposes of control, etc. In such an example, the GUI may provide for making one or more adjustments to a predicted formation top position, which may be utilized as feedback, for example, for ML model training, re-training, etc. As an example, a framework may provide for quality control such as, for example, determining mean absolute error (MAE) during an evaluation, which may be in a pre-job phase. As an example, where MAE in a pre-job phase is less than approximately one meter (e.g., or other suitable value), a framework may be deemed to be able to provide a sufficient level of confidence for implementation during a real-time job. As an example, a framework may provide for applying quality control to automatically generated predictions.

As an example, a framework may perform log correlation in a manner that may be dynamically updated. For example, consider a framework that may consider a "last horizon" (e.g., a last formation top) that may be dynamically update by correlating a last point of a current well to a nearest offset well. For example, consider a technique described in U.S. Pat. No. 11,531,138, entitled "Processes and systems for correlating well logging data", as issued 20 Dec. 2022, which is incorporated by reference herein in its entirety. As an example, a framework may provide for issuing one or more notices as to one or more quality metrics. For example, if a prediction does not pass a quality control process, a framework may issue a notification such that review may be performed (e.g., using one or more GUIs, etc.). As an example, consider a scenario where a framework has correlated WellTop 2 and is waiting for a prediction of WellTop 3 (e.g., a deeper well top). In such an example, if after some amount of time of waiting, the correlation point in an offset well (e.g., the correlation of the last point of the current well) has already passed WellTop 3 in the offset well, while still no prediction is showing up in the current well, a framework may issue one or more notifications (e.g., one or more warnings) that may prompt one or more individuals to consider whether there may be a benefit of manually correlating WellTop 3 for the current well.

In various trials, a framework provided automated well log correlation solution for geosteering before landing in a manner that achieves an average of 89 percent accuracy given an error tolerance of approximately 15 ft. Such a framework provides for rapid and consistent well log correlation during geosteering, which may be utilized to implement one or more levels of automation in geosteering (e.g., auto-geosteering).

As an example, a workflow may implement one or more techniques as described in an article by Chen et al., "XGBoost: A Scalable Tree Boosting System", arXiv: 1603.02754, 2016, which is incorporated by reference herein in its entirety. As an example, one or more types of models may be utilized. For example, consider CATBoost, light GBM, random forest, ensemble, SVM, etc.

As an example, an ML model may be a classifier, which may be selected based on amount of training and/or testing data available and/or based on one or more other criteria (e.g., computational demand, etc.). ML model classifiers may include, for example, perceptron models, naive Bayes models, decision tree models, logistic regression models, k-nearest neighbor (KNN) models, artificial neural network (ANN) models, deep learning (DL) ANN models, support vector machines (SVMs), etc. As an example, a classifier may be implemented using one or more types of ensemble techniques, such as, for example, random forest, bagging, AdaBoost, XGBoost, CATBoost, etc.

As an example, XGBoost may operate akin to a Newton-Raphson technique in a function space (e.g., gradient boosting may operate as a gradient descent in function space) where a second order Taylor approximation may be used in a loss function to make a connection to the Newton Raphson technique. As an example, an XGBoost process may include inputting a training set, a loss function (e.g., differentiable), a number of weak learners (M), and a learning rate; initializing a model with a constant value; computing gradients and Hessians for the number of weak learners; fitting a base learner (e.g., or weak learner, which may be a tree) using the training set (e.g., for m=1 to M); updating the model (e.g., for m=1 to M); and outputting a result of the XGBoost process.

As explained, a framework may implement windowing and summing where, for example, windowing may provide for generation of results at different scales where results may be summed to provide a maximum or a minimum that may correspond to a predicted position of a formation top (e.g., a well top), as may depend on base values assigned to various classes. As explained, a scheme may assign a maximum value to a zero distance class or may assign a minimum value to a zero distance class to make a prediction problem based on maximization or minimization.

As an example, upon termination of a job, data acquired during the job may be utilized as offset well data from another job. As an example, where a group of wells is to be drilled in sequence, offset well data may be selected at least in part on availability of data, which may correspond to completion of a job (e.g., drilling of a well). Where a first well in a group of wells is to be drilled, offset well data may be selected based on a proximity criterion and/or an analogy criterion where an analogous subsurface environment may exist at a location that may be proximate to the location of the group of wells or may be distant therefrom.

As an example, an ML model may be a relatively lightweight model that may be suitable for rapid building and implementation where, for example, predictions may be generated in real-time responsive to receipt of downhole data. As explained, such predictions may provide for real-time control of drilling such as, for example, geosteering.

As an example, a framework may be utilized in combination with one or more other frameworks. For example, consider utilization of the PETREL framework, which may provide for data access for pre-job modeling. As an example, during drilling, a framework may be implemented in combination with the DRILLOPS framework.

As an example, a framework may implement a machine learning model trained using data from a number of offset wells where the machine learning model may be trained and implemented without testing of the machine learning model.

Figure 11:
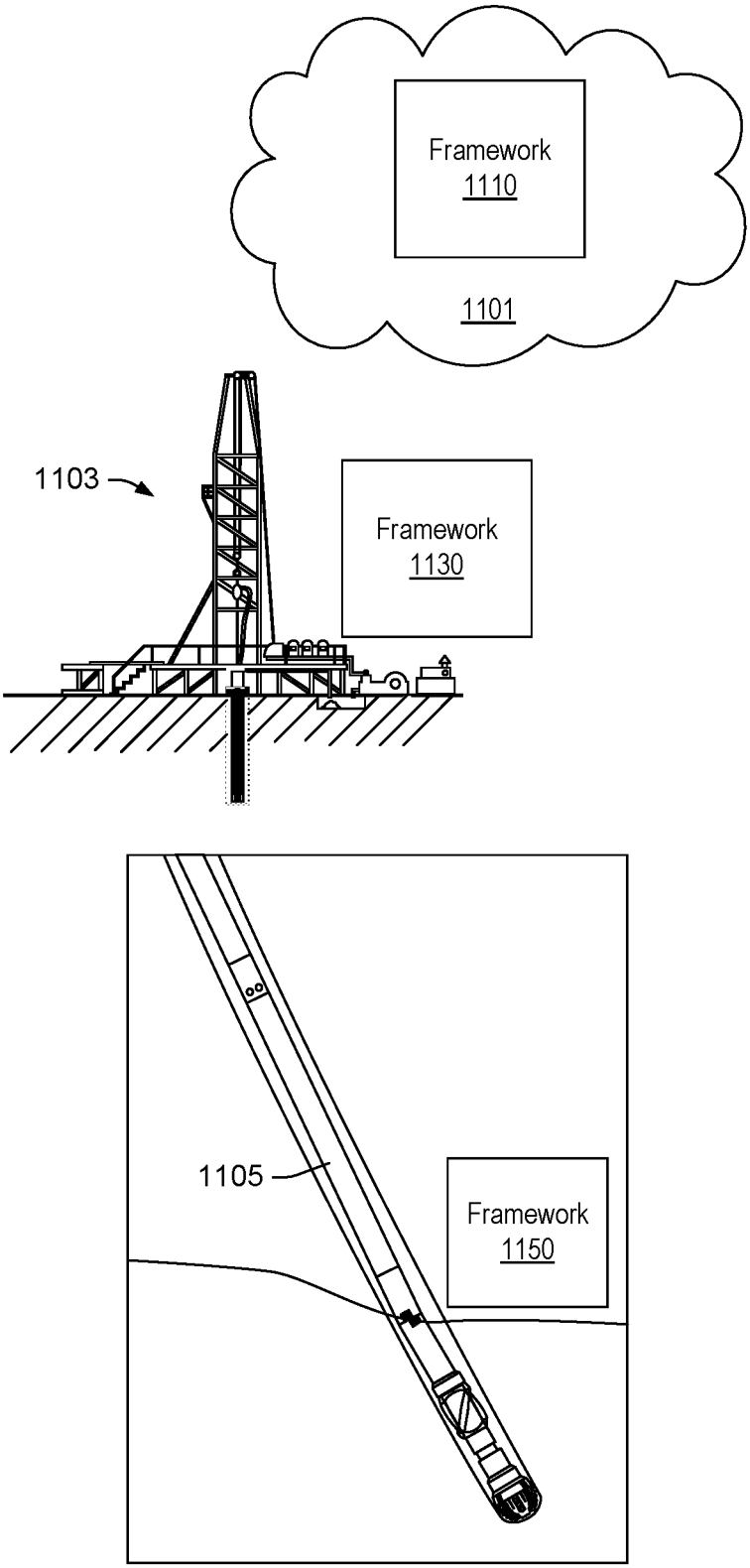
FIG. 11 illustrates examples of environments and frameworks.

FIG. 11 shows various examples of environments 1101, 1103 and 1105 that may host frameworks 1110, 1120 and 1130. For example, the environment 1101 may be a cloud platform environment that may host the framework 1110, which may provide for generating and/or implementing one or more machine learning models, the environment 1103 may be a rig site environment that may host the framework 1130, which may provide for generating and/or implementing one or more machine learning models, and the environment 1105 may be a tool string environment that may host the framework 1150, which may provide for generating and/or implementing one or more machine learning models. As an example, equipment at the rig site environment 1103 may be operatively coupled to equipment of the cloud platform environment 1101 and/or the tool string environment 1105.

As an example, a tool string may include an embedded framework that may provide for downhole automated control of one or more operations of the tool string, which may include, for example, geosteering. As an example, a rig control system (RCS) may include an embedded framework that may provide for control of one or more operations, which may include, for example, geosteering. In such an example, one or more levels of automation may be implemented such that the framework forms part of a control loop, which may be a closed control loop and/or a human-in-the-loop (HITL) type of control loop. As an example, a cloud platform may be utilized for one or more purposes, which may include model building, model updating, data access, synthetic data generation, etc. As an example, where a model is to be updated, an updated model may be provided via one or more environments for implementation in the field, for example, at a rig site environment and/or in a tool string environment.

As to types of machine learning models, consider one or more of a support vector machine (SVM) model, a k-nearest neighbors (KNN) model, an ensemble classifier model, a neural network (NN) model, etc. As an example, a machine learning model may be a deep learning model (e.g., deep Boltzmann machine, deep belief network, convolutional neural network, stacked auto-encoder, etc.), an ensemble model (e.g., random forest, gradient boosting machine, bootstrapped aggregation, AdaBoost, stacked generalization, gradient boosted regression tree, etc.), a neural network model (e.g., radial basis function network, perceptron, back-propagation, Hopfield network, etc.), a regularization model (e.g., ridge regression, least absolute shrinkage and selection operator, elastic net, least angle regression), a rule system model (e.g., cubist, one rule, zero rule, repeated incremental pruning to produce error reduction), a regression model (e.g., linear regression, ordinary least squares regression, stepwise regression, multivariate adaptive regression splines, locally estimated scatterplot smoothing, logistic regression, etc.), a Bayesian model (e.g., naïve Bayes, average on-dependence estimators, Bayesian belief network, Gaussian naïve Bayes, multinomial naïve Bayes, Bayesian network), a decision tree model (e.g., classification and regression tree, iterative dichotomiser 3, C4.5, C5.0, chi-squared automatic interaction detection, decision stump, conditional decision tree, M5), a dimensionality reduction model (e.g., principal component analysis, partial least squares regression, Sammon mapping, multidimensional scaling, projection pursuit, principal component regression, partial least squares discriminant analysis, mixture discriminant analysis, quadratic discriminant analysis, regularized discriminant analysis, flexible discriminant analysis, linear discriminant analysis, etc.), an instance model (e.g., k-nearest neighbor, learning vector quantization, self-organizing map, locally weighted learning, etc.), a clustering model (e.g., k-means, k-medians, expectation maximization, hierarchical clustering, etc.), etc.

As an example, a machine model, which may be a machine learning model (ML model), may be built using a computational framework with a library, a toolbox, etc., such as, for example, those of the MATLAB framework (MathWorks, Inc., Natick, Massachusetts). The MATLAB framework includes a toolbox that provides supervised and unsupervised machine learning algorithms, including support vector machines (SVMs), boosted and bagged decision trees, k-nearest neighbor (KNN), k-means, k-medoids, hierarchical clustering, Gaussian mixture models, and hidden Markov models. Another MATLAB framework toolbox is the Deep Learning Toolbox (DLT), which provides a framework for designing and implementing deep neural networks with algorithms, pretrained models, and apps. The DLT provides convolutional neural networks (ConvNets, CNNs) and long short-term memory (LSTM) networks to perform classification and regression on image, time-series, and text data. The DLT includes features to build network architectures such as generative adversarial networks (GANs) and Siamese networks using custom training loops, shared weights, and automatic differentiation. The DLT provides for model exchange various other frameworks.

As an example, the TENSORFLOW framework (Google LLC, Mountain View, CA) may be implemented, which is an open-source software library for dataflow programming that includes a symbolic math library, which may be implemented for machine learning applications that may include neural networks. As an example, the CAFFE framework may be implemented, which is a DL framework developed by Berkeley AI Research (BAIR) (University of California, Berkeley, California). As another example, consider the SCIKIT platform (e.g., scikit-learn), which utilizes the PYTHON programming language. As an example, a framework such as the APOLLO AI framework may be utilized (APOLLO.AI GmbH, Germany). As an example, a framework such as the PYTORCH framework may be utilized (Facebook AI Research Lab (FAIR), Facebook, Inc., Menlo Park, California).

As an example, a training method may include various actions that may operate on a dataset to train an ML model. As an example, a dataset may be split into training data and test data where test data may provide for evaluation. A method may include cross-validation of parameters and best parameters, which may be provided for model training.

The TENSORFLOW framework may run on multiple CPUs and GPUs (with optional CUDA (NVIDIA Corp., Santa Clara, California) and SYCL (The Khronos Group Inc., Beaverton, Oregon) extensions for general-purpose computing on graphics processing units (GPUs)). TENSORFLOW is available on 64-bit LINUX, MACOS (Apple Inc., Cupertino, California), WINDOWS (Microsoft Corp., Redmond, Washington), and mobile computing platforms including ANDROID (Google LLC, Mountain View, California) and IOS (Apple Inc.) operating system-based platforms.

TENSORFLOW computations may be expressed as stateful dataflow graphs; noting that the name TENSORFLOW derives from the operations that such neural networks perform on multidimensional data arrays. Such arrays may be referred to as "tensors".

As an example, a device may utilize TENSORFLOW LITE (TFL) or another type of lightweight framework. For example, consider a gateway that may be in the field (e.g., on-site) and that may utilize the TFL and/or one or more other types of lightweight frameworks. The TFL framework is a set of tools that enables on-device machine learning where models may run on mobile, embedded, and IoT devices. The TFL framework is optimized for on-device machine learning, by addressing latency (no round-trip to a server), privacy (no personal data leaves the device), connectivity (Internet connectivity is demanded), size (reduced model and binary size) and power consumption (e.g., efficient inference and a lack of network connections). The TFL framework offers multiple platform support, covering ANDROID and iOS devices, embedded LINUX, and microcontrollers. The TFL framework offers diverse language support includes JAVA, SWIFT, Objective-C, C++, and PYTHON. The TFL framework may provide high performance via hardware acceleration and model optimization.

Figure 12:
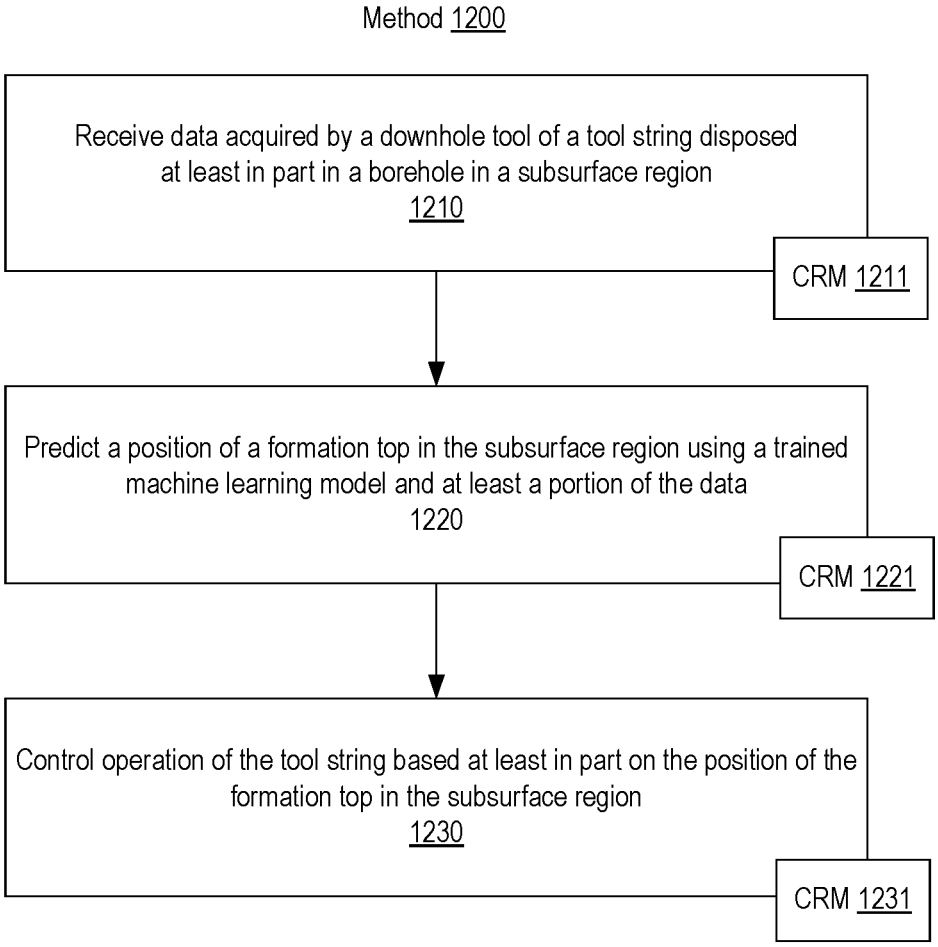
FIG. 12 illustrates an example of a method and an example of a system.
Figure 12:
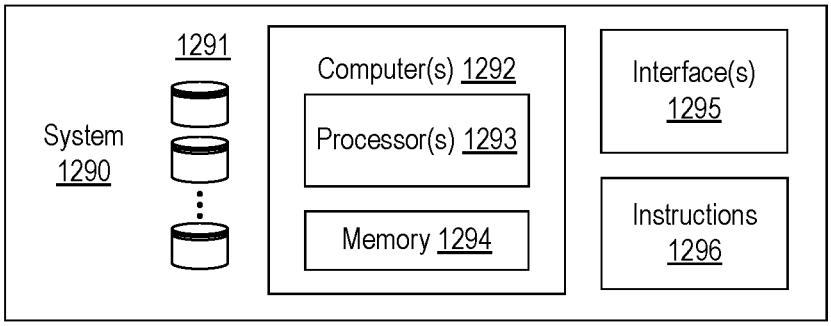

FIG. 12 shows an example of a method 1200 that includes a reception block 1210 for receiving data acquired by a downhole tool of a tool string disposed at least in part in a borehole in a subsurface region; a prediction block 1220 for predicting a position of a formation top in the subsurface region using a trained machine learning model and at least a portion of the data; and a control block 1230 for controlling operation of the tool string based at least in part on the position of the formation top in the subsurface region.

The method 1200 of FIG. 12 is shown as including various computer-readable storage medium (CRM) blocks 1211, 1221, and 1231 that may include processor-executable instructions that may instruct a computing system, which may be a control system, to perform one or more of the actions described with respect to the method 1200.

As shown in the example of FIG. 12, the system 1290 may include one or more computers 1292 that include one or more processors 1293, memory 1294 operatively coupled to at least one of the one or more processors 1293, instructions 1296 that may be, for example, stored in the memory 1294, and one or more interfaces 1295 (e.g., one or more network interfaces and/or other interfaces). As an example, the system 1290 may include one or more processor-readable media that include processor-executable instructions executable by at least one of the one or more processors 1293 to cause the system 1290 to perform actions such as, for example, one or more actions of the method 1200. As an example, the instructions 1296 may include instructions of one or more of the CRM blocks 1211, 1221, and 1231. The memory 1294 may be or include the one or more processor-readable media where the processor-executable instructions may be or include instructions. As an example, a processor-readable medium may be a computer-readable storage medium that is non-transitory that is not a signal and that is not a carrier wave.

As an example, the system 1290 may include subsystems 1291. For example, the system 1290 may include a plurality of subsystems 1291 that may operate using equipment that is distributed where a subsystem may be referred to as being a system. For example, consider a downhole tool system and a surface system. As an example, operations of the blocks 1210, 1220, and 1230 of the method 1200 may be performed using a downhole tool system. The method 1200 may be implemented using, for example, a downhole system and/or a surface system, which may be a cloud-based or cloud-coupled system.

As an example, a method may include receiving data acquired by a downhole tool of a tool string disposed at least in part in a borehole in a subsurface region; predicting a position of a formation top in the subsurface region using a trained machine learning model and at least a portion of the data; and controlling operation of the tool string based at least in part on the position of the formation top in the subsurface region. In such an example, the data may include one or more of gamma ray data, resistivity data, and neutron data.

As an example, a tool string may include a bottom hole assembly that includes a drill bit. As an example, a tool string may be a directional drilling tool string. For example, a tool string may include one or more tools for directional drilling, for example, to orient a drill bit.

As an example, a trained machine learning model may be or include a tree-based model. For example, consider a decision tree-based model, which may be a boosted decision tree-based model, which may be a gradient boosted decision tree-based model.

As an example, a trained machine learning model may include classes, where, for example, the classes may include base values assigned to reduce data imbalance. As an example, classes may include a zero distance class assigned the highest base value or the lowest base value and, for example, distance range classes. In such an example, the distance range classes may include distance ranges less than approximately 10 meters from a zero distance class.

As an example, a method may include predicting that utilizes different window sizes to reduce error. In such an example, the window sizes may include a local distance range, a medium distance range, and a long distance range. As an example, predicting may predict a position by summing outputs for different window sizes and by selecting a highest sum or a lowest sum (e.g., depending on how classes may be defined).

As an example, a method may include receiving data where receiving the data is via mud-pulse telemetry. As an example, a method may include receiving data where receiving the data is via wire-based telemetry.

As an example, a tool string may include circuitry that implements a trained machine learning model. In such an example, a position may be a relative position with respect to the tool string in a borehole.

As an example, a method may include performing predicting utilizing surface equipment. In such an example, the method may include generating a control command utilizing the surface equipment, where a controlling operation is based at least in part on the control command. As an example, a controlling operation may include geosteering a drill bit of a tool string in a borehole.

As an example, a system may include a processor; memory accessible to the processor; and processor-executable instructions stored in the memory and executable by the processor to instruct the system to: receive data acquired by a downhole tool of a tool string disposed at least in part in a borehole in a subsurface region; predict a position of a formation top in the subsurface region using a trained machine learning model and at least a portion of the data; and control operation of the tool string based at least in part on the position of the formation top in the subsurface region.

As an example, one or more non-transitory computer-readable storage media may include processor-executable instructions executable to instruct a processor to: receive data acquired by a downhole tool of a tool string disposed at least in part in a borehole in a subsurface region; predict a position of a formation top in the subsurface region using a trained machine learning model and at least a portion of the data; and control operation of the tool string based at least in part on the position of the formation top in the subsurface region.

As an example, one or more computer-readable storage media may include processor-executable instructions to instruct a computing system to perform one or more methods. In such an example, the one or more computer-readable storage media may be a program product (e.g., a computer program product, a computer system program product, etc.).

Figure 13:
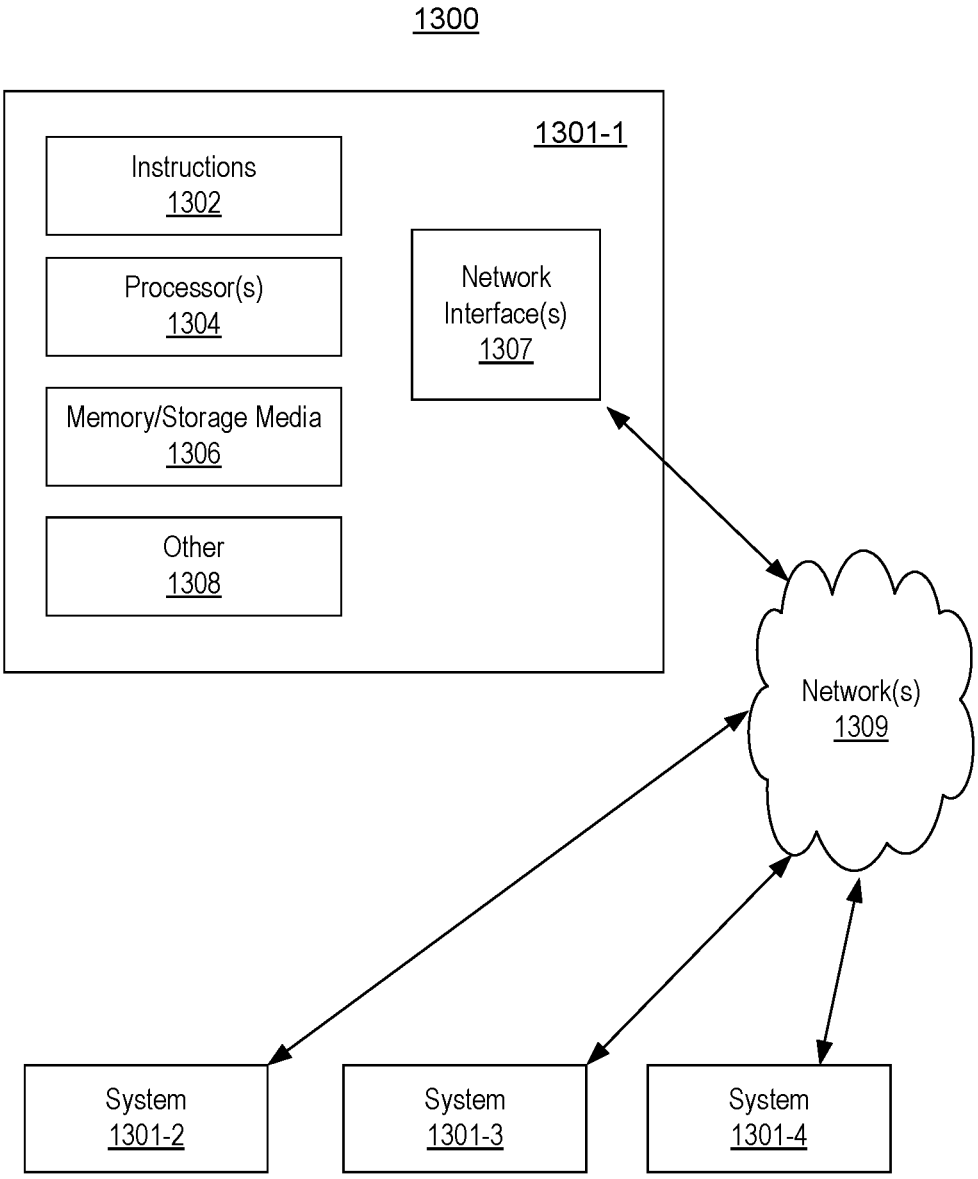
FIG. 13 illustrates examples of computing and networking equipment.

In some embodiments, a method or methods may be executed by a computing system. FIG. 13 shows an example of a system 1300 that may include one or more computing systems 1301-1, 1301-2, 1301-3 and 1301-4, which may be operatively coupled via one or more networks 1309, which may include wired and/or wireless networks.

As an example, a system may include an individual computer system or an arrangement of distributed computer systems. In the example of FIG. 13, the computer system 1301-1 may include one or more sets of instructions 1302, which may be or include processor-executable instructions, for example, executable to perform various tasks (e.g., receiving information, requesting information, processing information, simulation, outputting information, etc.).

As an example, a set of instructions may be executed independently, or in coordination with, one or more processors 1304, which is (or are) operatively coupled to one or more storage media 1306 (e.g., via wire, wirelessly, etc.). As an example, one or more of the one or more processors 1304 may be operatively coupled to at least one of one or more network interface 1307. In such an example, the computer system 1301-1 may transmit and/or receive information, for example, via the one or more networks 1309 (e.g., consider one or more of the Internet, a private network, a cellular network, a satellite network, etc.). As shown, one or more other components 1308 may be included.

As an example, the computer system 1301-1 may receive from and/or transmit information to one or more other devices, which may be or include, for example, one or more of the computer systems 1301-2, etc. A device may be located in a physical location that differs from that of the computer system 1301-1. As an example, a location may be, for example, a processing facility location, a data center location (e.g., server farm, etc.), a rig location, a wellsite location, a downhole location, etc.

As an example, a processor may be or include a microprocessor, microcontroller, processor component or subsystem, programmable integrated circuit, programmable gate array, or another control or computing device.

As an example, the storage media 1306 may be implemented as one or more computer-readable or machine-readable storage media. As an example, storage may be distributed within and/or across multiple internal and/or external enclosures of a computing system and/or additional computing systems.

As an example, a storage medium or storage media may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLUERAY disks, or other types of optical storage, or other types of storage devices.

As an example, a storage medium or media may be located in a machine running machine-readable instructions, or located at a remote site from which machine-readable instructions may be downloaded over a network for execution.

As an example, various components of a system such as, for example, a computer system, may be implemented in hardware, software, or a combination of both hardware and software (e.g., including firmware), including one or more signal processing and/or application specific integrated circuits.

As an example, a system may include a processing apparatus that may be or include a general-purpose processors or application specific chips (e.g., or chipsets), such as ASICs, FPGAs, PLDs, or other appropriate devices.

As an example, a device may be a mobile device that includes one or more network interfaces for communication of information. For example, a mobile device may include a wireless network interface (e.g., operable via IEEE 802.11, ETSI GSM, BLUETOOTH, satellite, etc.). As an example, a mobile device may include components such as a main processor, memory, a display, display graphics circuitry (e.g., optionally including touch and gesture circuitry), a SIM slot, audio/video circuitry, motion processing circuitry (e.g., accelerometer, gyroscope), wireless LAN circuitry, smart card circuitry, transmitter circuitry, GPS circuitry, and a battery. As an example, a mobile device may be configured as a cell phone, a tablet, etc. As an example, a method may be implemented (e.g., wholly or in part) using a mobile device. As an example, a system may include one or more mobile devices.

As an example, a system may be a distributed environment, for example, a so-called "cloud" environment where various devices, components, etc. interact for purposes of data storage, communications, computing, etc. As an example, a device or a system may include one or more components for communication of information via one or more of the Internet (e.g., where communication occurs via one or more Internet protocols), a cellular network, a satellite network, etc. As an example, a method may be implemented in a distributed environment (e.g., wholly or in part as a cloud-based service).

As an example, information may be input from a display (e.g., consider a touchscreen), output to a display or both. As an example, information may be output to a projector, a laser device, a printer, etc. such that the information may be viewed. As an example, information may be output stereographically or holographically. As to a printer, consider a 2D or a 3D printer. As an example, a 3D printer may include one or more substances that may be output to construct a 3D object. For example, data may be provided to a 3D printer to construct a 3D representation of a subterranean formation. As an example, layers may be constructed in 3D (e.g., horizons, etc.), geobodies constructed in 3D, etc. As an example, holes, fractures, etc., may be constructed in 3D (e.g., as positive structures, as negative structures, etc.).

Although only a few examples have been described in detail above, those skilled in the art will readily appreciate that many modifications are possible in the examples. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A method comprising:

during drilling of a borehole in a subsurface region using a tool string disposed at least in part in the borehole, receiving data acquired by a downhole tool of the tool string wherein the data spans a range of depths in the borehole;

predicting a position of a formation top in the subsurface region using a trained machine learning model that, for each depth increment in the range of depths, predicts a corresponding distance class, from a number of different distance classes, using at least a portion of the data, wherein the distance classes comprise base values assigned to reduce data imbalance, wherein the distance classes comprise distance range classes, and wherein the distance range classes comprise distance ranges less than approximately 10 meters from a zero distance class; and directionally controlling the drilling based at least in part on the position of the formation top in the subsurface region to form a landing section of the borehole for further drilling to extend the borehole in a target formation in the subsurface region.

2. The method of claim 1, wherein the data comprise one or more of gamma ray data, resistivity data, and neutron data.

3. The method of claim 1, wherein the tool string comprises a bottom hole assembly that comprises a drill bit.

4. The method of claim 1, wherein the tool string is a directional drilling tool string.

5. The method of claim 1, wherein the trained machine learning model comprises a tree-based model.

6. The method of claim 1, wherein the distance classes comprise a zero distance class assigned the highest base value or the lowest base value.

7. The method of claim 1, wherein the predicting utilizes different window sizes to reduce error.

8. The method of claim 7, wherein the window sizes comprise a local distance range, a medium distance range, and a long distance range.

9. The method of claim 7, wherein the predicting predicts the position by summing outputs for the different window sizes and by selecting a highest sum or a lowest sum.

10. The method of claim 1, wherein the receiving comprises receiving the data via mud-pulse telemetry.

11. The method of claim 1, wherein the receiving comprises receiving the data via wire-based telemetry.

12. The method of claim 1, wherein the tool string comprises circuitry that implements the trained machine learning model, and wherein the position is a relative position with respect to the tool string in the borehole.

13. The method of claim 1, comprising performing the predicting utilizing surface equipment.

14. The method of claim 13, comprising generating a control command utilizing the surface equipment, wherein the controlling operation is based at least in part on the control command.

15. The method of claim 1, wherein the controlling operation comprises geosteering a drill bit of the tool string in the borehole.

16. A system comprising:

a processor;

memory accessible to the processor; and processor-executable instructions stored in the memory and executable by the processor to instruct the system to:

during drilling of a borehole in a subsurface region using a tool string disposed at least in part in the borehole, receive data acquired by a downhole tool of the tool string wherein the data spans a range of depths in the borehole;

predict a position of a formation top in the subsurface region using a trained machine learning model that, for each depth increment in the range of depths, predicts a corresponding distance class, from a number of different distance classes, using at least a portion of the data, wherein the distance classes comprise base values assigned to reduce data imbalance, wherein the distance classes comprise distance range classes, and wherein the distance range classes comprise distance ranges less than approximately 10 meters from a zero distance class; and directionally control the drilling based at least in part on the position of the formation top in the subsurface region to form a landing section of the borehole for further drilling to extend the borehole in a target formation in the subsurface region.

17. One or more non-transitory computer-readable storage media comprising processor-executable instructions executable to instruct a processor to:

during drilling of a borehole in a subsurface region using a tool string disposed at least in part in the borehole, receive data acquired by a downhole tool of the tool string, wherein the data spans a range of depths in the borehole;

predict a position of a formation top in the subsurface region using a trained machine learning model that, for each depth increment in the range of depths, predicts a corresponding distance class, from a number of different distance classes, using at least a portion of the data, wherein the distance classes comprise base values assigned to reduce data imbalance, wherein the distance classes comprise distance range classes, and wherein the distance range classes comprise distance ranges less than approximately 10 meters from a zero distance class; and directionally control the drilling based at least in part on the position of the formation top in the subsurface region to form a landing section of the borehole for further drilling to extend the borehole in a target formation in the subsurface region.

* * * * *